US008600097B2

(12) United States Patent
McGhee et al.

(10) Patent No.: US 8,600,097 B2
(45) Date of Patent: Dec. 3, 2013

(54) INTEGRATED RIGGING SYSTEM FOR LOUDSPEAKERS WITH VERTICALLY AND HORIZONTALLY ORIENTED LOCKING PIN HOLES AND DOLLY BOARD PLACED IN ABUTMENT WITH ADJACENT DOLLY BOARDS

(75) Inventors: John McGhee, Parkdale, OR (US); Alejandro Garcia Rubio, Berkeley, CA (US); Dean Marshall, San Rafael, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 122 days.

(21) Appl. No.: 13/159,290

(22) Filed: Jun. 13, 2011

(65) Prior Publication Data

US 2011/0305362 A1 Dec. 15, 2011

Related U.S. Application Data

(60) Provisional application No. 61/354,123, filed on Jun. 11, 2010.

(51) Int. Cl.
*H04R 1/02* (2006.01)
*A47B 81/06* (2006.01)

(52) U.S. Cl.
USPC ..... 381/386; 181/198; 181/199

(58) Field of Classification Search
USPC ..... 381/87, 334–335, 386–387, 395; 181/144–145, 198–199, 148, 150
See application file for complete search history.

(56) References Cited

U.S. PATENT DOCUMENTS

| | | | | |
|---|---|---|---|---|
| 4,101,109 | A | 7/1978 | Edwards | |
| 4,660,728 | A | 4/1987 | Martin | |
| 5,000,286 | A | 3/1991 | Crawford et al. | |
| 5,266,751 | A | 11/1993 | Taguchi | |
| 5,620,272 | A | 4/1997 | Sheng | |
| 5,758,852 | A | 6/1998 | Martin | |
| 5,816,545 | A | 10/1998 | Malizia | |
| 5,819,959 | A | 10/1998 | Martin | |
| 5,996,728 | A | 12/1999 | Stark | |
| 6,009,182 | A | 12/1999 | Gunness | |
| 6,536,554 | B2 | 3/2003 | Andrews et al. | |
| 6,640,924 | B2 | 11/2003 | Messner | |
| 6,652,046 | B2 | 11/2003 | Christner | |
| 7,201,251 | B1 | 4/2007 | Baird | |
| 7,298,860 | B2 | 11/2007 | Engebretson et al. | |
| 7,328,769 | B1 | 2/2008 | Adamson | |
| 7,634,100 | B2 * | 12/2009 | Monitto et al. | 381/386 |
| 7,693,296 | B2 | 4/2010 | Monitto | |
| 2004/0213425 | A1 * | 10/2004 | Simidian et al. | 381/335 |
| 2006/0210095 | A1 * | 9/2006 | Monitto et al. | 381/87 |

* cited by examiner

*Primary Examiner* — Brian Ensey
*Assistant Examiner* — Katherine Faley
(74) *Attorney, Agent, or Firm* — Brian Beverly; Beeson Skinner Beverly, LLP

(57) ABSTRACT

An integrated rigging system for loudspeakers comprises top and base front and top and base rear rigging structures for mounting to the internal framework of the loudspeaker and for forming the top front, base front, top rear and base rear portions of the loudspeaker's enclosure, and a plurality of links, each link extendable from a link stowing channel in one of the rigging structures into a link receiving slot in the corresponding rigging structure of the enclosure of an abutting loudspeaker for linking the rigging structure of the loudspeaker with the corresponding rigging structure of the enclosure of the abutting loudspeaker.

22 Claims, 21 Drawing Sheets

INTEGRATED RIGGING SYSTEM FOR LOUDSPEAKERS WITH VERTICALLY AND HORIZONTALLY ORIENTED LOCKING PIN HOLES AND DOLLY BOARD PLACED IN ABUTMENT WITH ADJACENT DOLLY BOARDS

CROSS-REFERENCE TO RELATED APPLICATIONS

This application claims the benefit of U.S. Provisional Application No. 61/354,123, filed Jun. 11, 2010.

BACKGROUND

The present invention relates to loudspeaker rigging systems and more particularly to a rigging system integrated into a loudspeaker for suspending a vertical or horizontal array of loudspeakers of a sound reinforcement system at a predetermined location relative to an audience. The present invention has particular application in facilitating the rigging of a splayed array of loudspeakers.

Sound systems for large venues typically involve the suspension or "flying" of vertical or horizontal arrays of loudspeakers arranged and positioned to achieve a desired acoustic output and coverage for a large audience. Such arrays of loudspeakers are typically suspended and held together by rigging systems which may be attached to rigging hoists which position the stack at a desired elevation and location, typically above or in the vicinity of a performance stage. A flown array of loudspeakers can include many speaker boxes and the rigging system for flying the stack must be strong enough to support the weight of the large array. Such rigging systems generally involve the use of metal frame elements secured to the speaker boxes that can be used to link the speakers together in a stacked arrangement and to lift the stack to an overhead flying position. This generally requires that two metal frame elements be attached to each speaker box to adapt it to be included in an array of such speakers. The frame elements are attached to the sides of each speaker box and adjoining speakers are linked with locking pins inserted perpendicularly to the frame element and the side of the speaker, leaving the head of the locking pins protruding from the frame elements. While this arrangement works well, it makes it difficult to assemble any array of loudspeakers, such as a horizontal array, on a ground surface that requires setting the speakers in the array on the side on which the frame elements are attached. Moreover, valuable labor is required to set up such speaker arrays, slowing the process, and a separate inventory of metal frame elements must be acquired and tracked.

There is therefore a need to integrate a rigging mechanism into the speaker box itself to simplify, facilitate and speed up the process of rigging speakers into arrays, reduce inventories, and decrease labor costs.

SUMMARY OF THE INVENTION

An integrated rigging system for loudspeakers and a loudspeaker containing the same comprises sturdy top front, base front, top rear and base rear rigging structures each of which are attached to rigid internal framework members of a loudspeaker enclosure, thereby forming the top fr ont front, base front, top rear and base rear portions of the enclosure. Attachment of top, bottom, front, side, and back panels to the rigid framework members completes a loudspeaker enclosure wherein loads created by linking multiple speakers in a vertical stack or in a horizontal array are carried by the rigging structures and rigid internal framework members which constitute the strongest parts of the loudspeaker enclosure.

Each rigging structure is formed from a primary plate and a channel member firmly attached to the primary member. Each channel includes on one side a link stowing channel for sliding disposition of a link, and on the other side a link receiving slot. The link can be manipulated in the link stowing channel via a gripping knob which is engaged in a guide slot such that the link may be moved from a stowed position to a deployed position by moving the gripping knob in the guide slot. In the stowed position, the link is fully received in the link stowing channel, and in the deployed position, an extended portion of the link projects from the side of the rigging structure and into the link receiving slot of an abutting loudspeaker. Each link has an its extended end a locking pin hole which aligns with cooperating locking pin holes in the link receiving slot of the abutting loudspeaker when the link is in the deployed position. Insertion of a locking pin through the locking pin holes of the link and the link receiving slot locks the link in the link receiving slot and securely links together the abutting loudspeakers.

Locator tabs are provided on the side edges of the rigging structures in a keyed arrangement so that when two loudspeakers are placed in abutting relation, proper registration of the locator tabs on the right side of the left speaker with the locator tabs on the left side of the right loudspeaker will align the front and rear ends of the two abutting loudspeakers.

A cooperating dolly board has a generally trapezoidal shape conforming to the wedge shape of the loudspeaker. The dolly board has a pronounced protrusion on the left side near its rear end and a correspondingly shaped recess on the right side such that the protrusion of a dolly board will fit snugly into the recess of another abutting dolly board. Forward and rear edges of the protrusion nest with forward and rear walls of the recess of the adjacent dolly board to orient and maintain the abutting dolly boards in front-to-back alignment. The dolly board has an extended portion on the right side forward of the recess and a cut-out section on the left side generally conforming to the extended portion such that the extended portion of a dolly board will be received in the cut-out section of another abutting dolly board. Wheels are attached to the bottom surface of the dolly board under the protrusion and the extended portion to provide a wider and more stable lateral wheel base near the rear end of the dolly board than would otherwise be possible.

BRIEF DESCRIPTION OF THE ILLUSTRATIONS

Figure 3A:
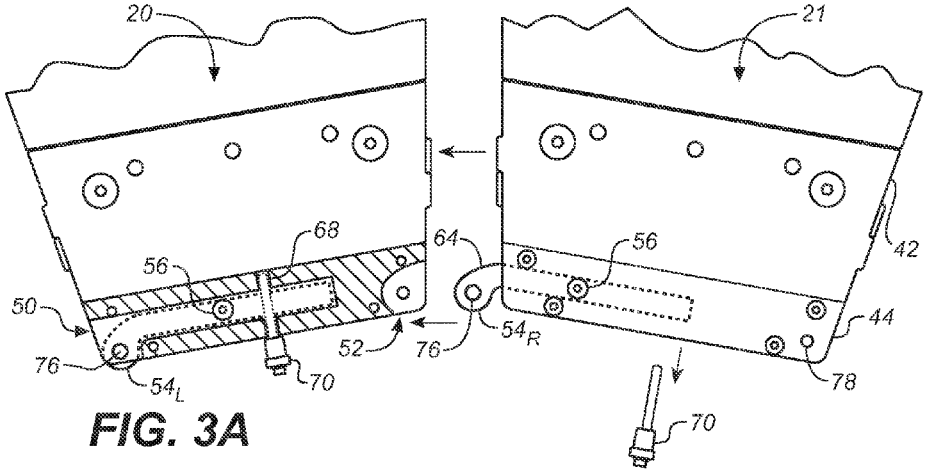
Figure 3B:
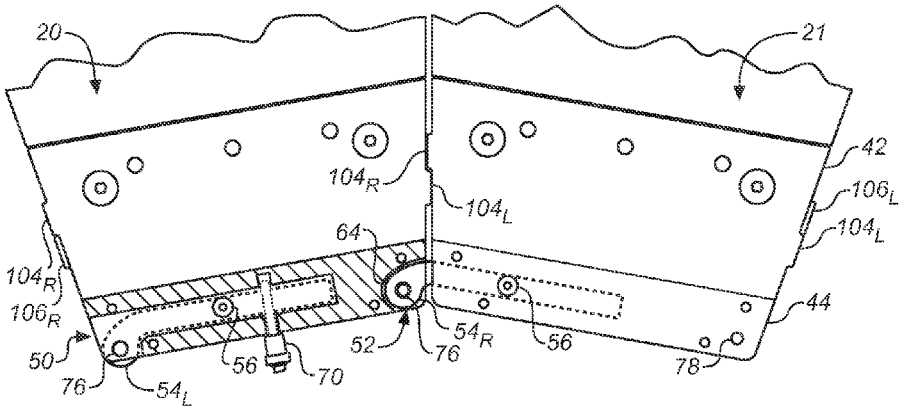

FIGS. 3A and 3B are close up plan views of the rear rigging structures of the integrated rigging systems of two adjacent loudspeakers, the left rigging structure shown in partial section view, wherein the rigging systems are shown spaced apart with the link associated with the right rigging structure removed from the link pin stowing hole of the right rigging structure in FIG. 3A and showing the rigging structures in abutting relation in FIG. 3B.

Figure 4:
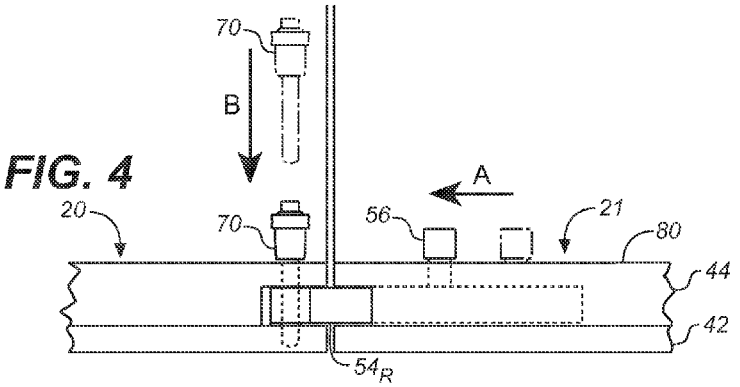

FIG. 4 is an elevational detail view of the abutting portions of the rear rigging structures seen in FIG. 3B showing the direction of movement of the link associated with the right rigging structure from the stowed position to the deployed position and showing insertion of the link pin in the locking pin holes of the left rigging structure to link the right and left rigging structures.

Figure 5:
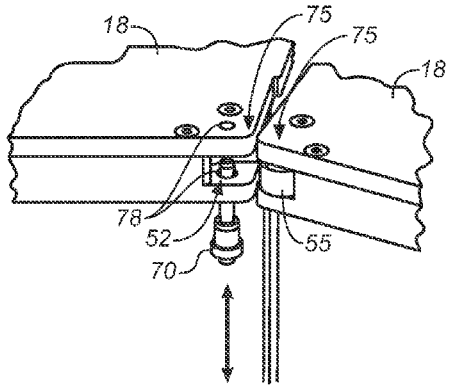

FIG. 5 is a close up partial upper perspective view of the upper rear rigging structures of two adjacent loudspeakers showing the vertical insertion path of locking pin into the locking pin hole of the left rigging structure.

Figure 6:
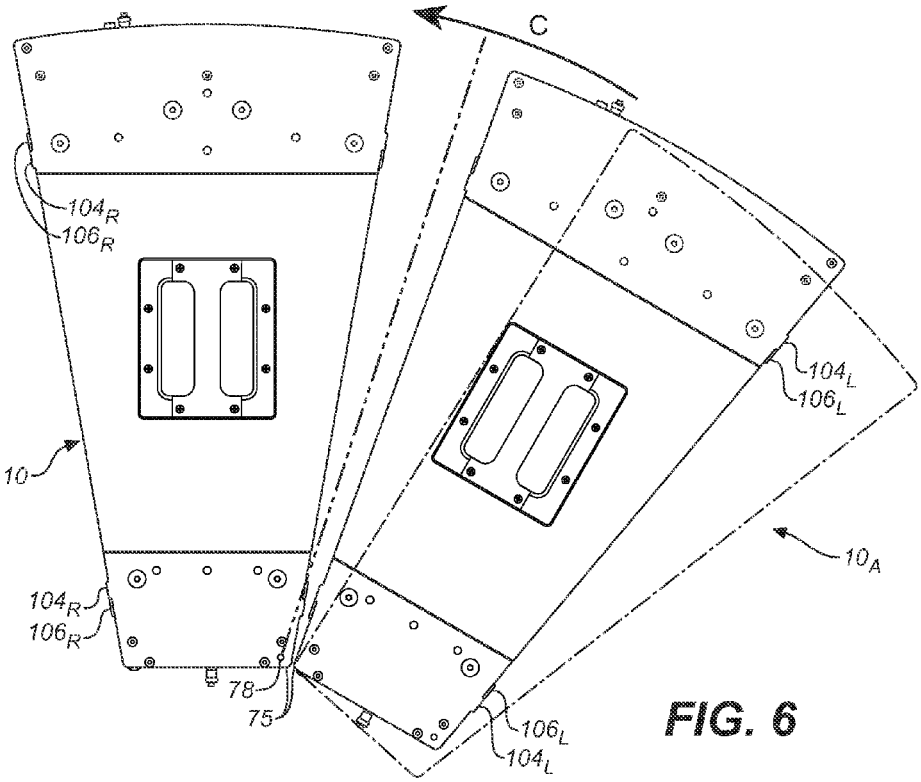

FIG. 6 is a plan view of two loudspeakers connected via their integrated rigging systems and pivotable about the pivot axis defined by the rear link pins.

Figure 7:
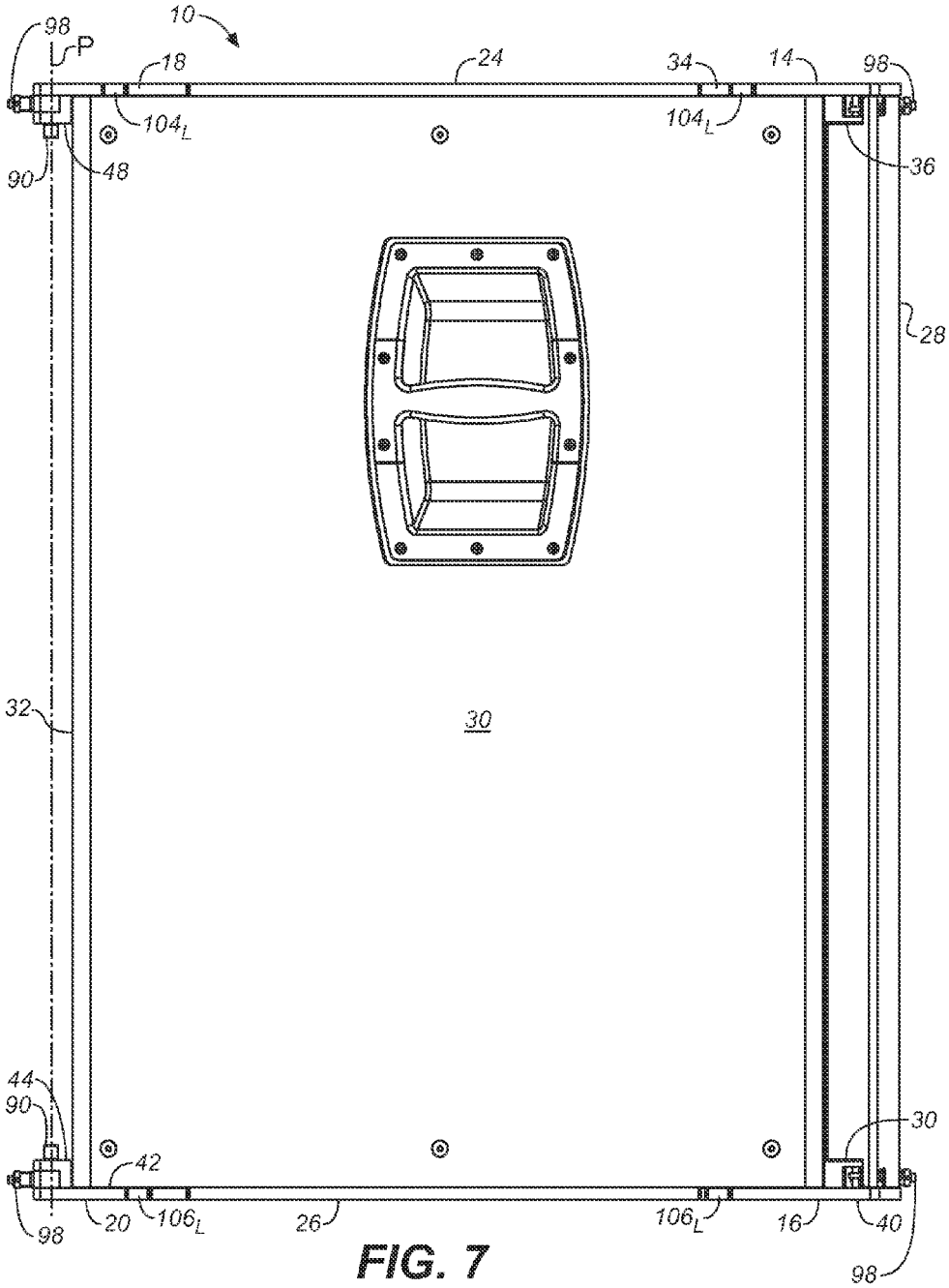

FIG. 7 is a side elevational view of a loudspeaker having an integrated rigging system according to the invention.

Figure 8A:
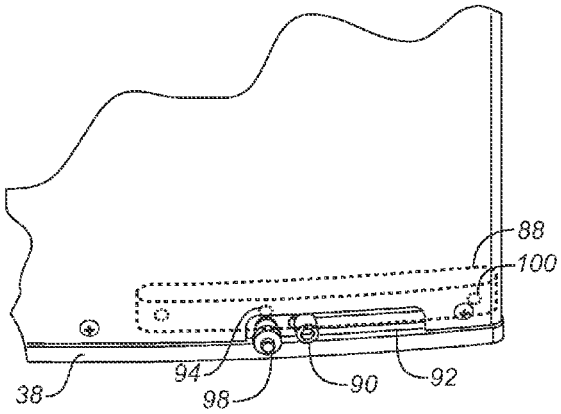
Figure 8B:
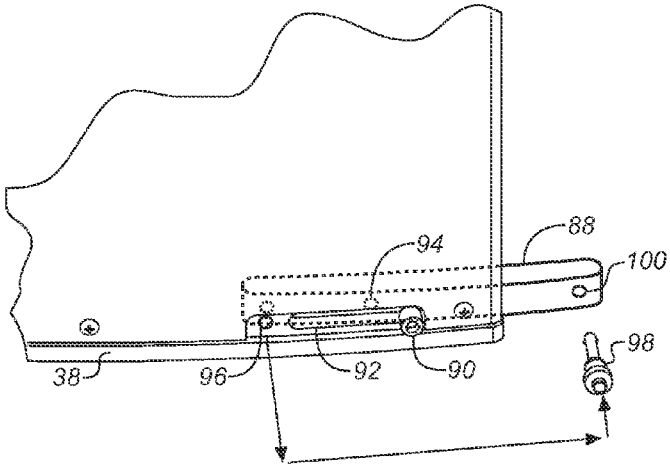

FIGS. 8A and 8B are close up upper perspective views of the lower right front of a loudspeaker and the front base rigging system of an integrated rigging system of the loudspeaker shown with the link in the stowed position in FIG. 8A and in the deployed position with the link pin removed from the link pin stowing hole and positioned for insertion in the locking pin hole of the link in FIG. 8B.

Figure 9A:
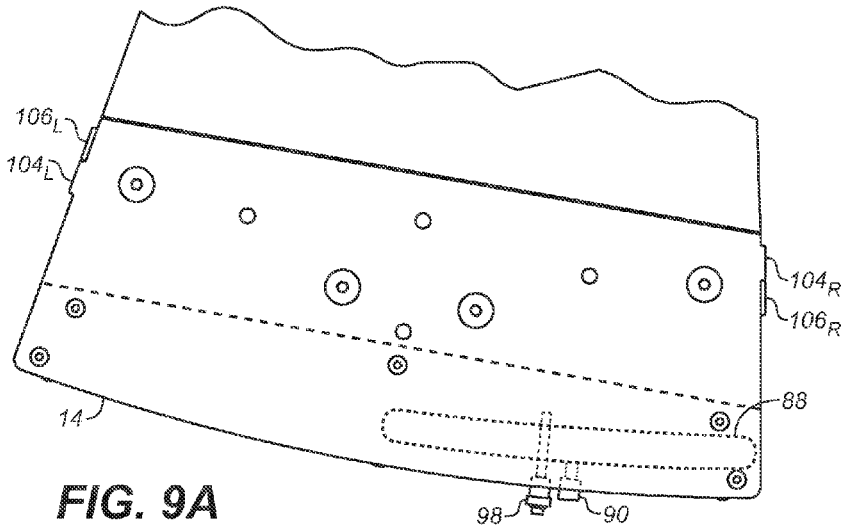
Figure 9B:
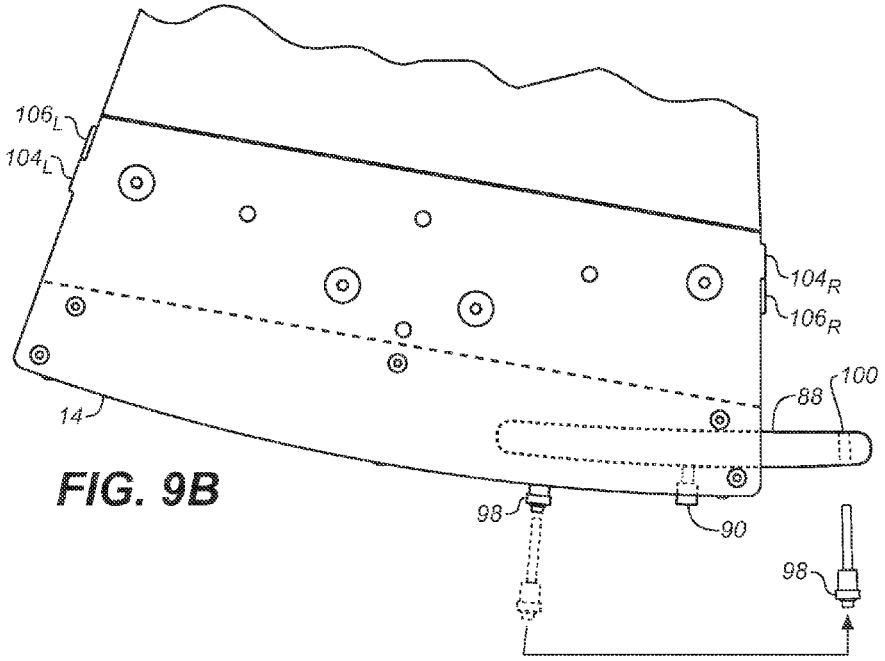

FIGS. 9A and 9B are close up plan views of the upper rigging structures of a loudspeaker shown with the link in the stowed position in FIG. 9A and in the deployed position with the link pin removed from the link pin stowing hole and positioned for insertion in the locking pin hole of the link in FIG. 9B.

Figure 10A:
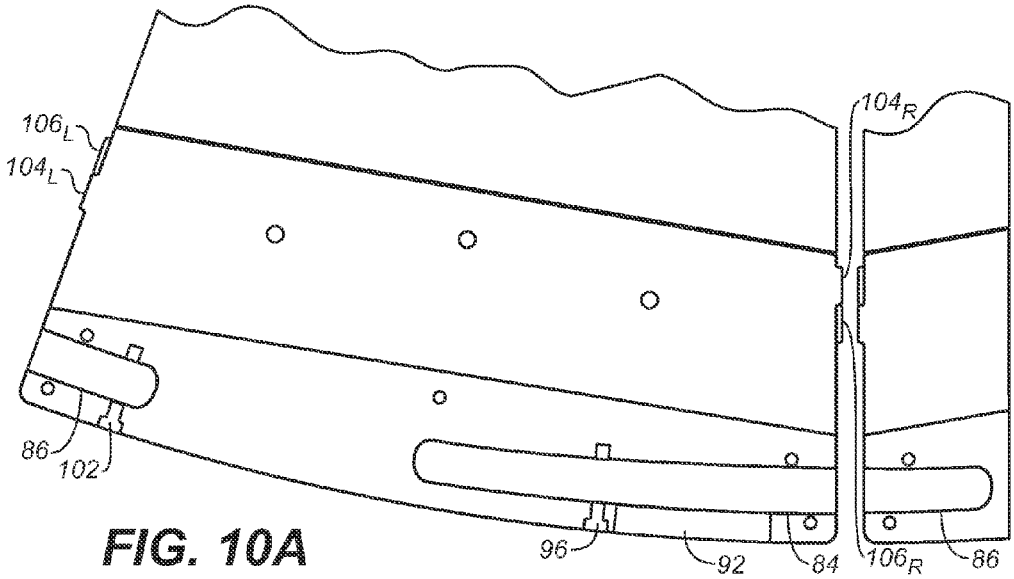

FIG. 10A is a sectional view of one of the front rigging structures showing the link receiving slot on the left and the link stowing channel on the right.

Figure 10B:
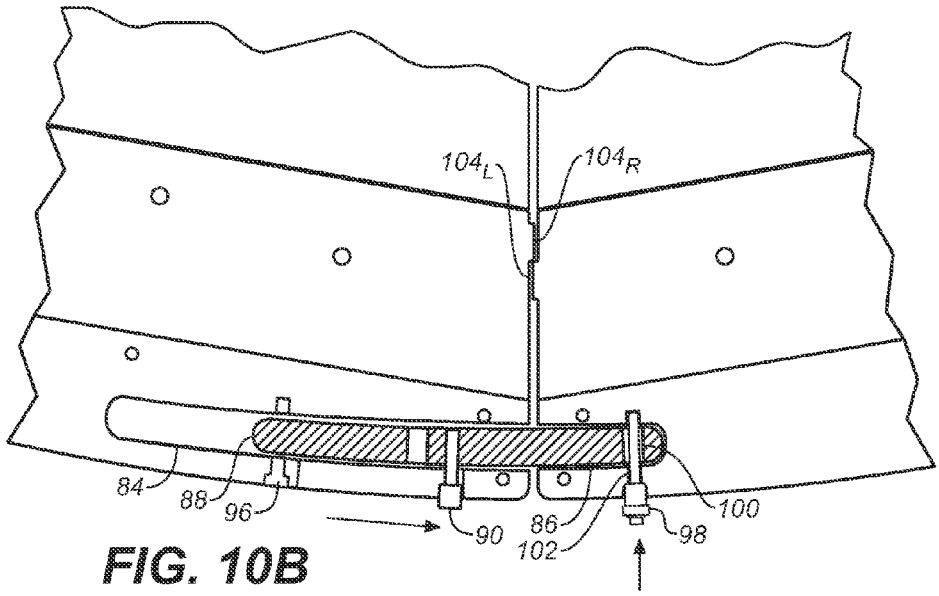

FIG. 10B is a sectional view of two front rigging structures positioned in abutting relation showing the link in the deployed position with the locking pin inserted in the locking pin holes of the link and of the link receiving slot of the right rigging structure.

Figure 11:
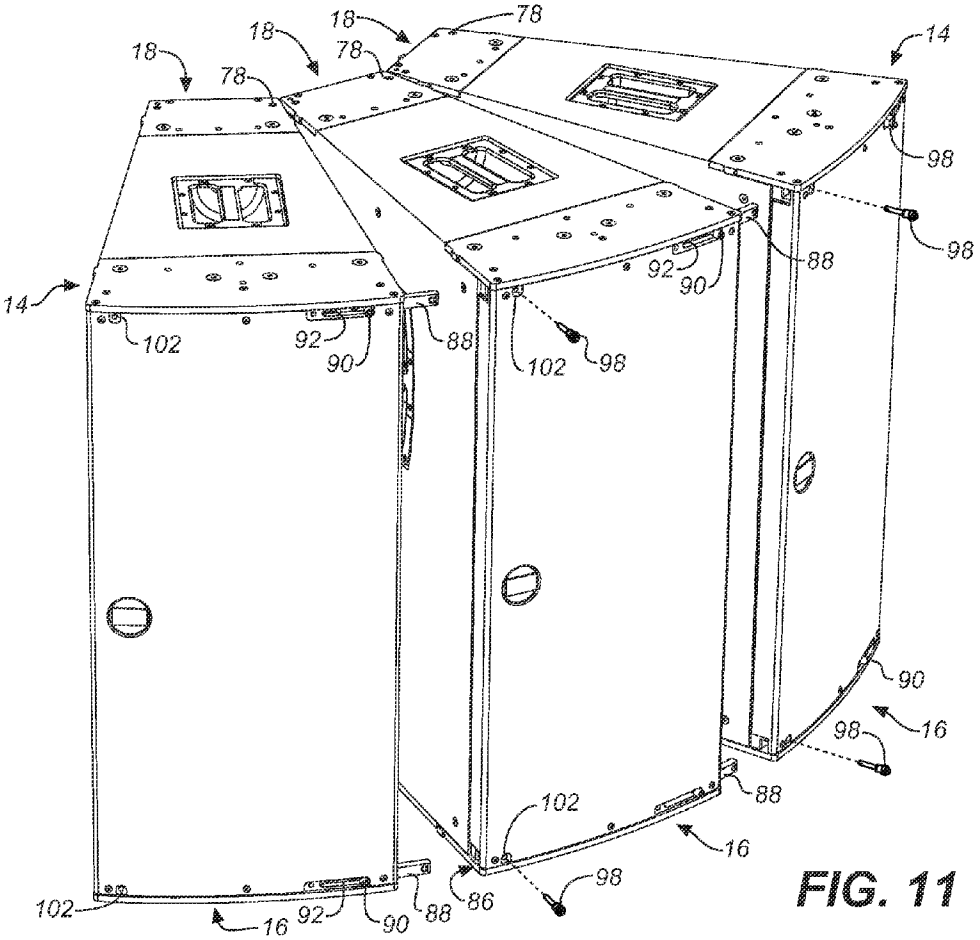

FIG. 11 is an upper perspective view of three integrated rigging systems of three loudspeakers linked in pivoting relation by their respective rear rigging structures and pivoted open with their front ends separated.

Figure 12:
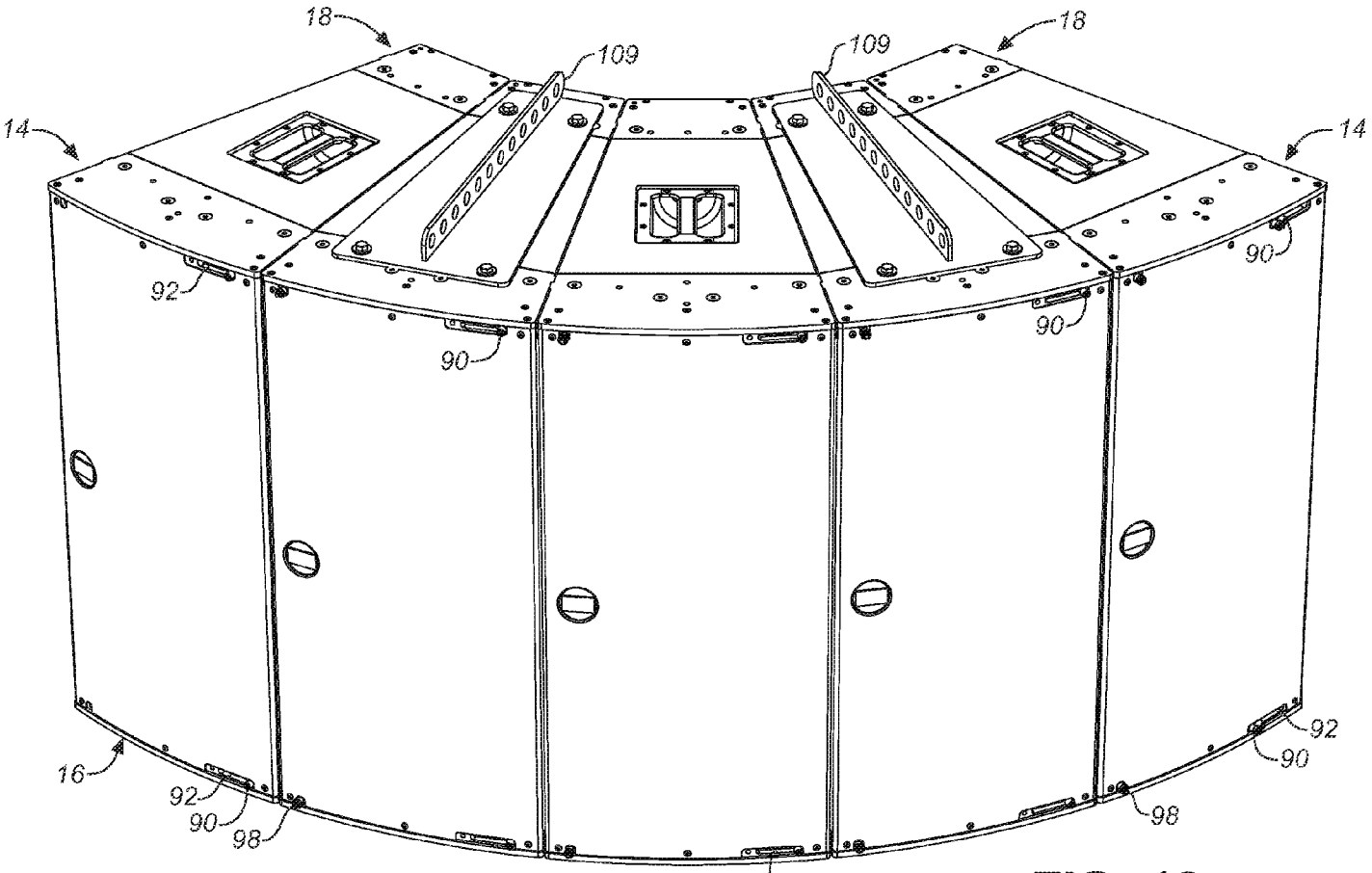

FIG. 12 is an upper perspective view of the integrated rigging systems of five speakers linked together and showing two pickup plates secured to the front and rear rigging structures of two of the loudspeakers.

Figure 13:
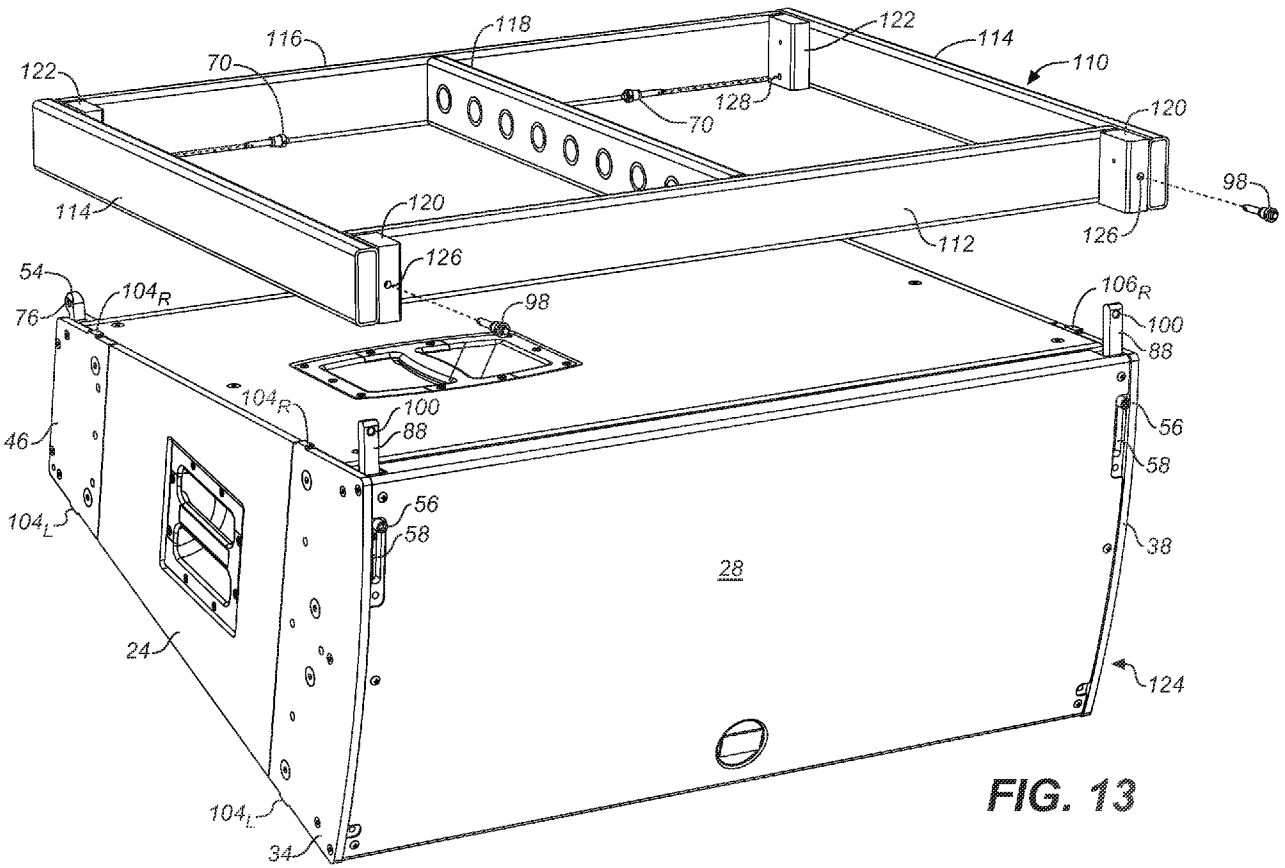

FIG. 13 is an upper perspective exploded view of an integrated rigging system of a loudspeaker and a lifting grid for lifting a vertical stack of linked loudspeakers.

Figure 14:
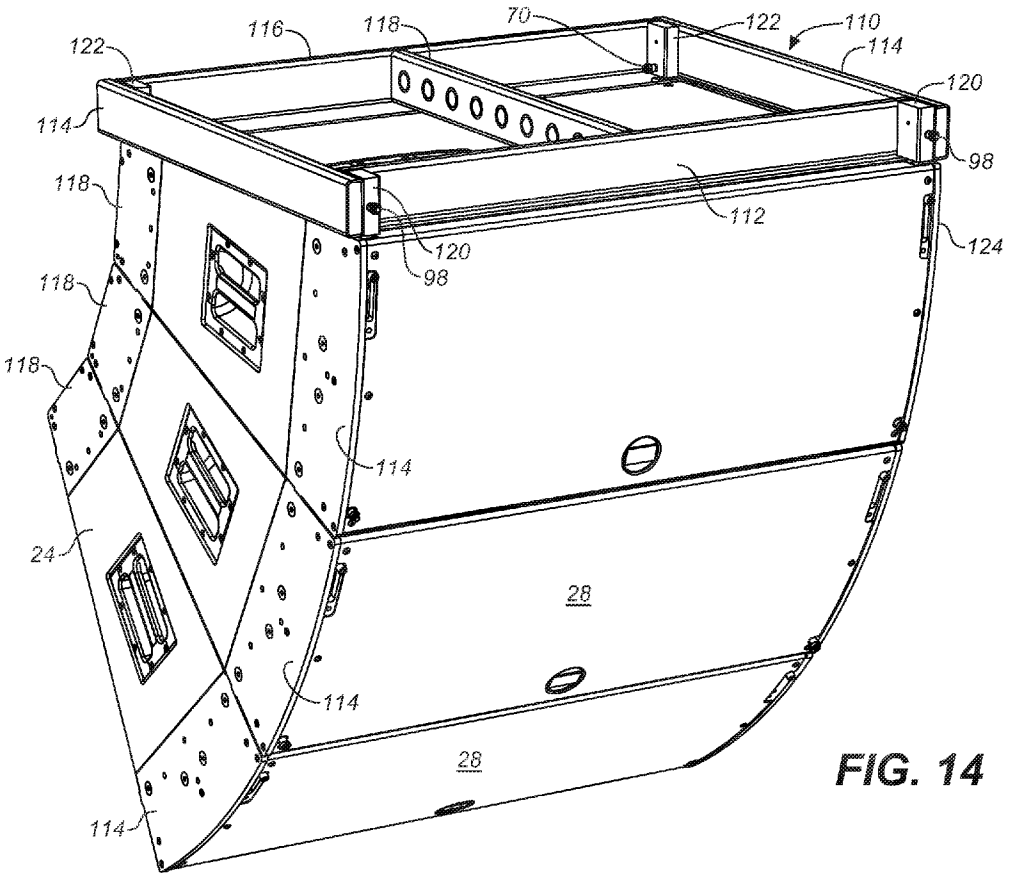

FIG. 14 is an upper perspective view of a vertical stack of loudspeakers having integrated rigging systems and a lifting grid.

Figure 15:
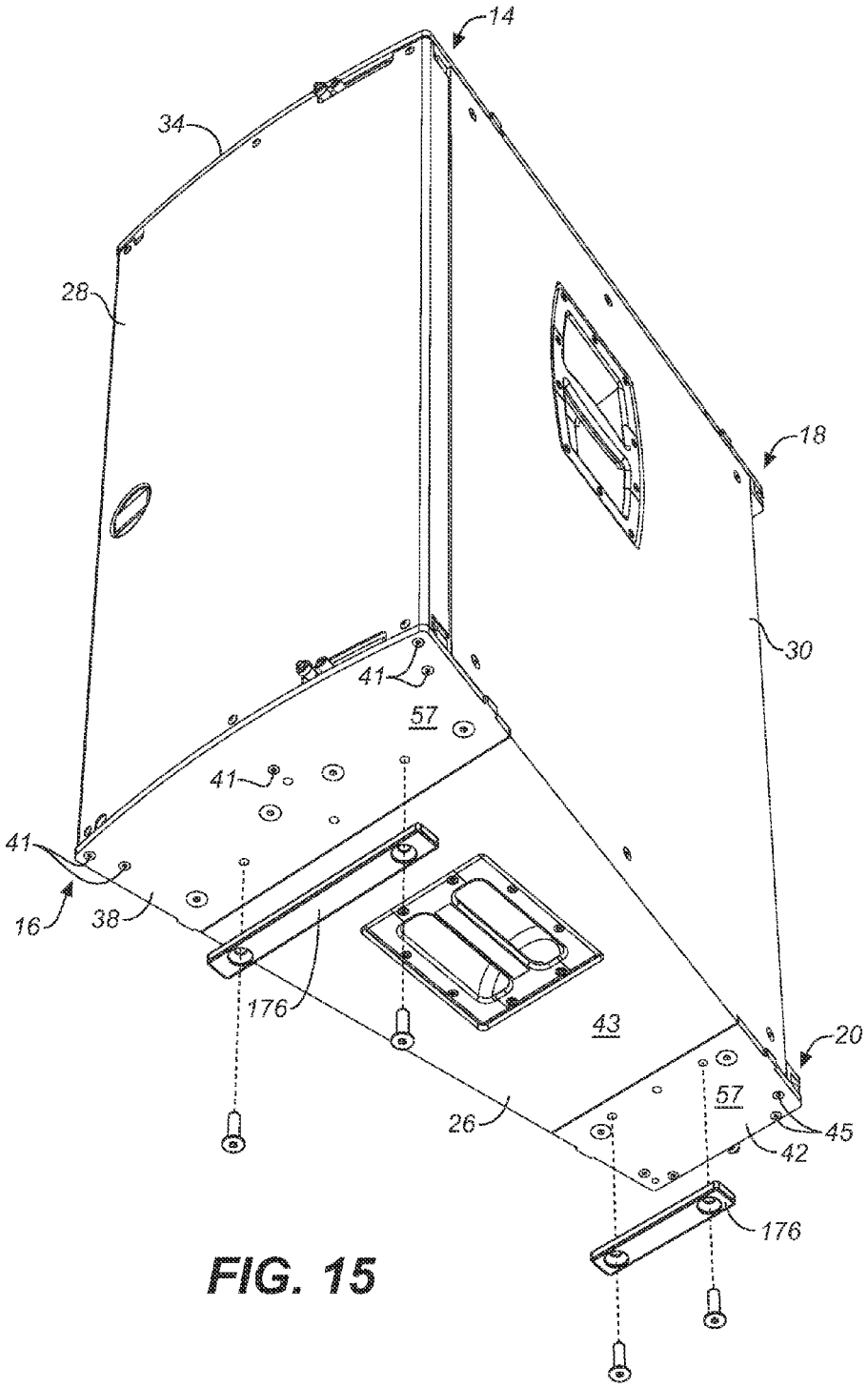
Figure 16:
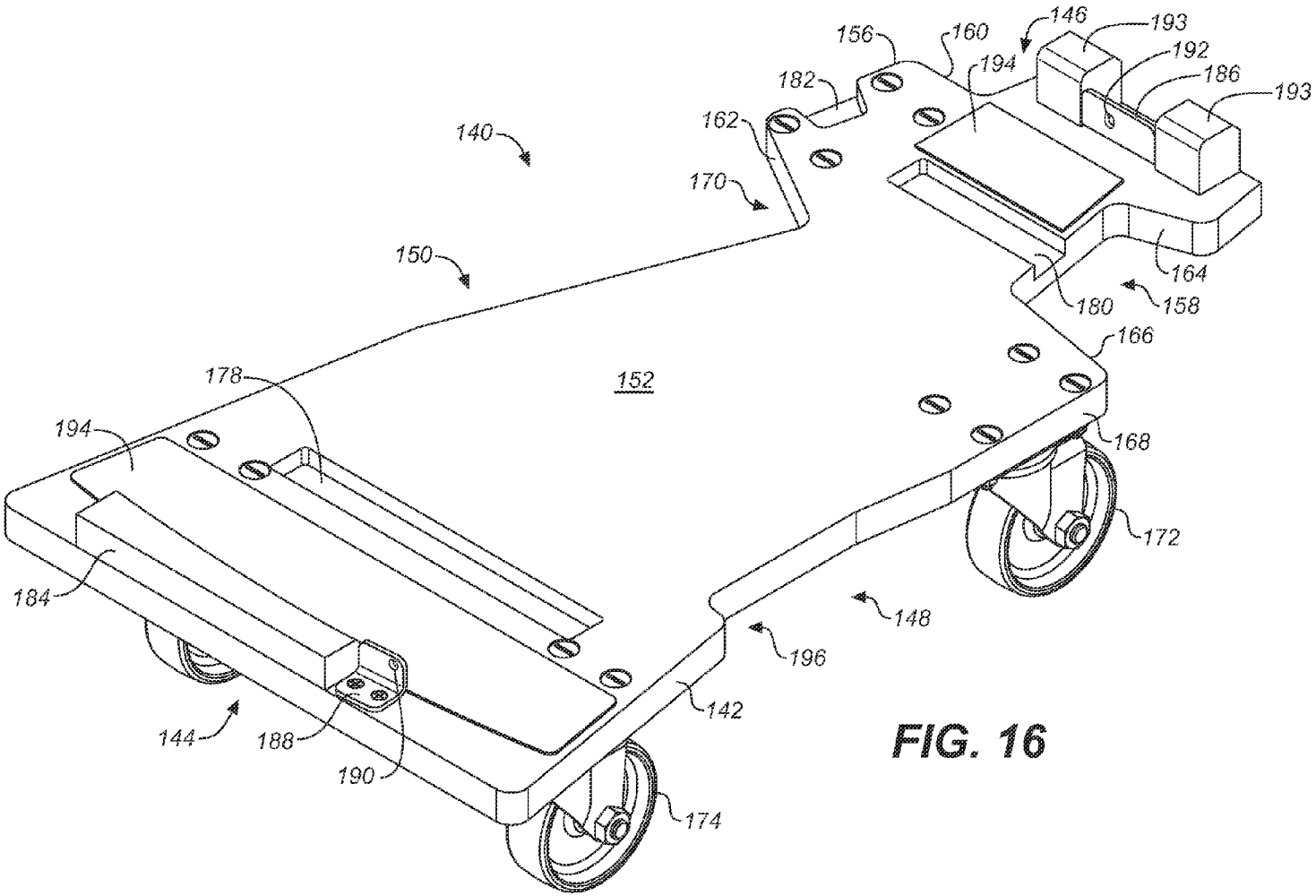

FIG. 15 is a bottom perspective view of the bottom end of a loudspeaker having an integrated rigging system and two locator strips for use in conjunction with the dolly board shown in FIG. 16.

FIG. 16 is an upper perspective view of a dolly board for carrying a loudspeaker having an integrated rigging system.

Figure 17:
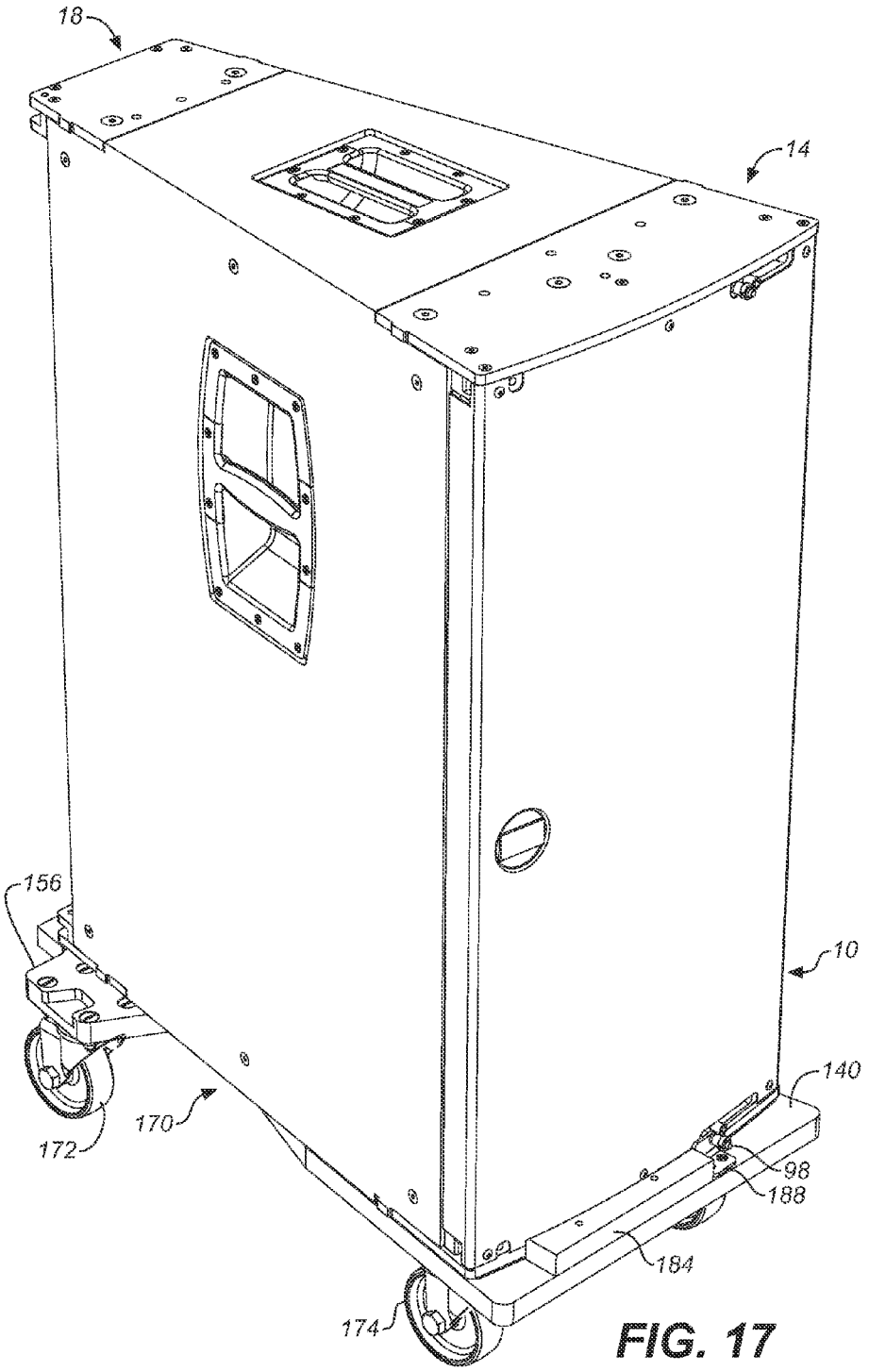

FIG. 17 is a front upper perspective view of a loudspeaker having an integrated rigging system positioned on the dolly board seen in FIG. 16.

Figure 18:
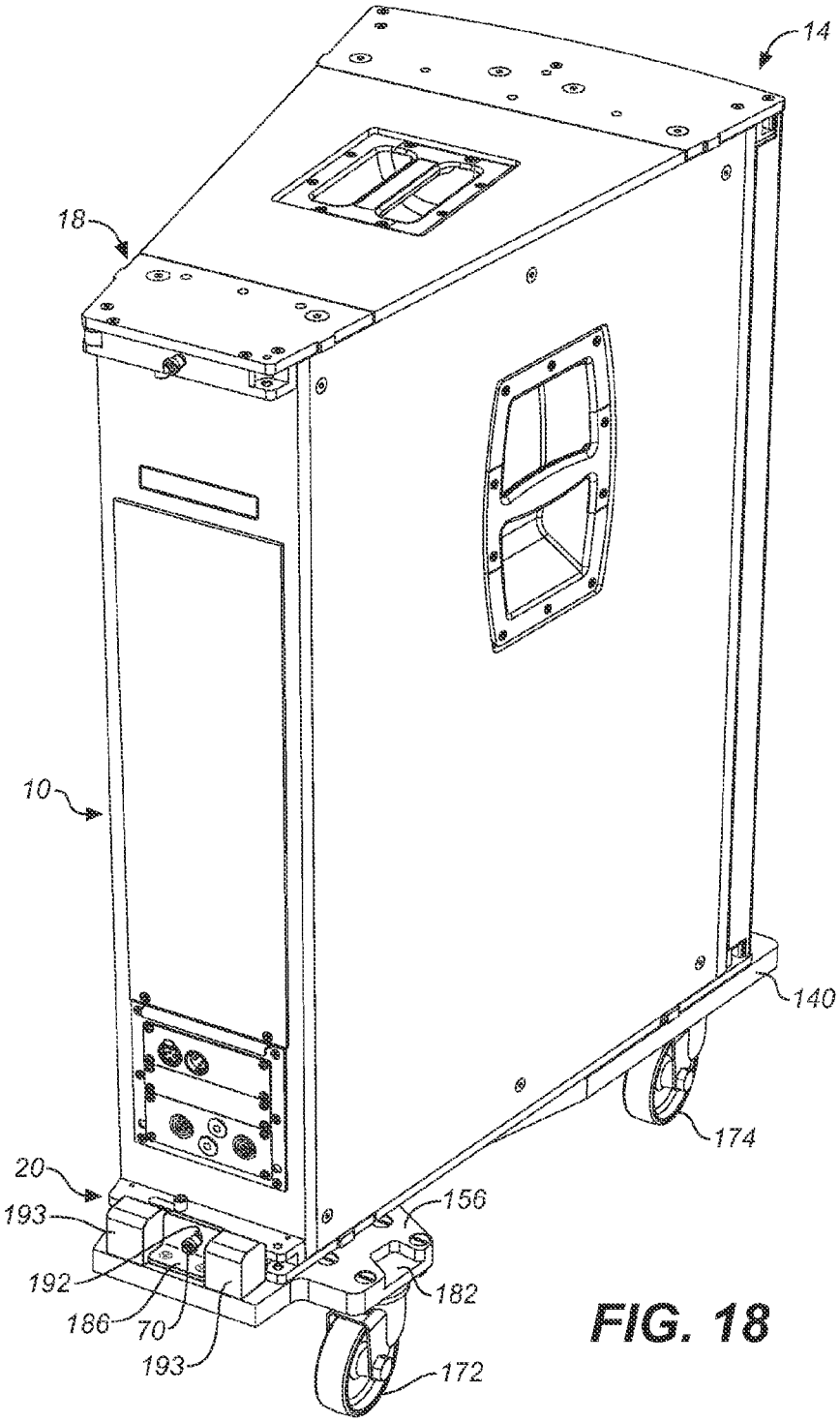

FIG. 18 is a rear upper perspective view of the loudspeaker having an integrated rigging system positioned on the dolly board seen in FIG. 17.

Figure 19:
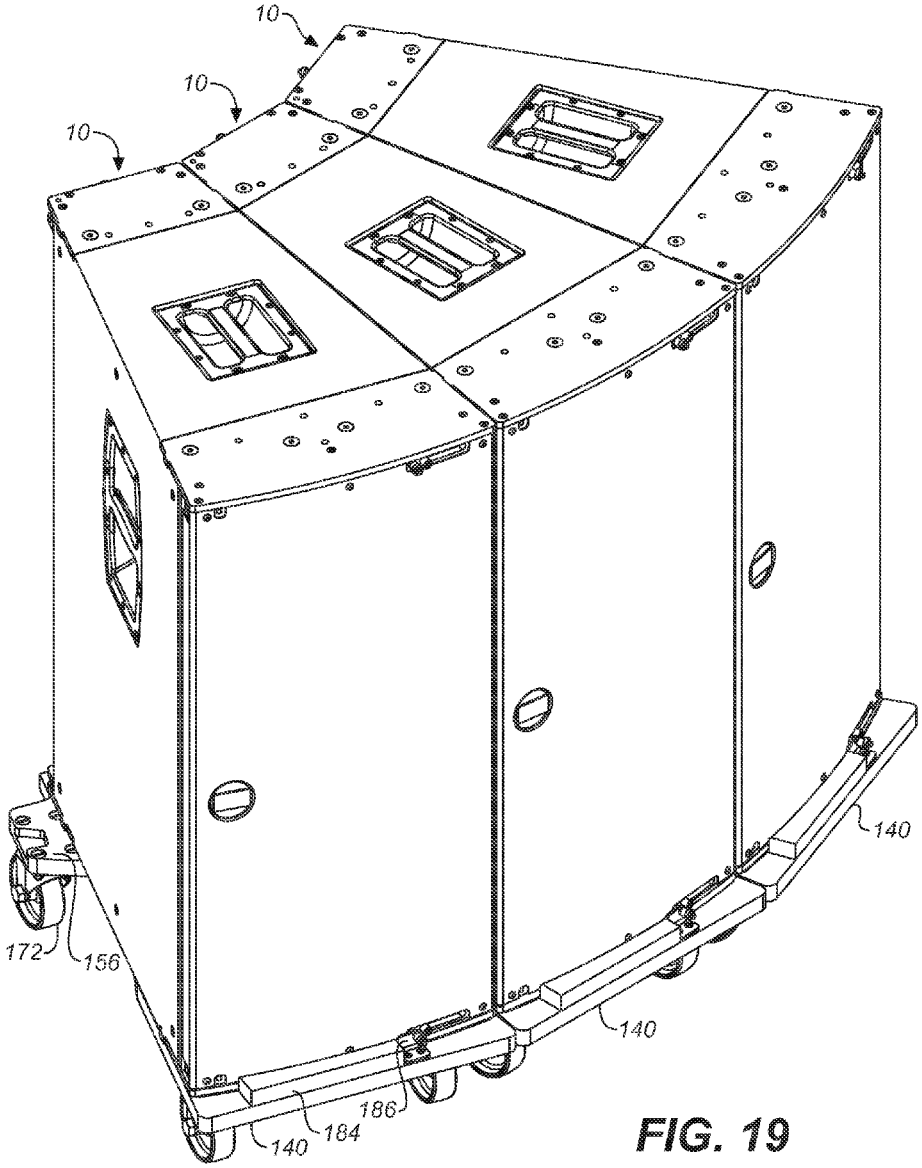

FIG. 19 is an upper perspective view of three loudspeakers having integrated rigging systems positioned on dolly boards and wheeled into abutting relation.

Figure 20A:
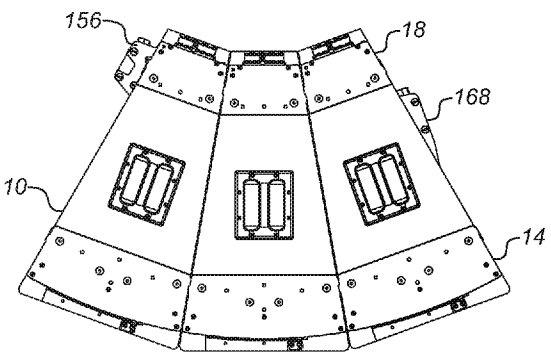

FIG. 20A is a top plan view of the loudspeakers shown in FIG. 19.

Figure 20B:
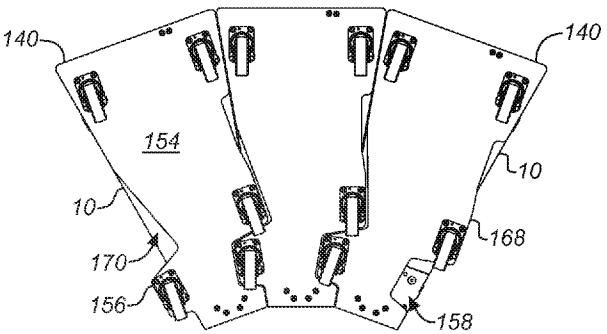

FIG. 20B is a bottom plan view of the dolly boards shown in FIG. 19.

Figure 21A:
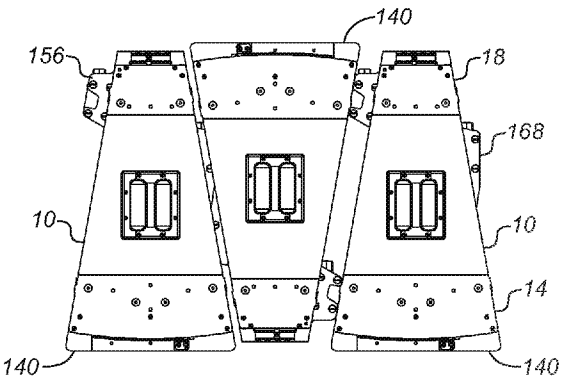

FIG. 21A is a top plan view of three loudspeakers having integrated rigging systems being carried on dolly boards and arranged in front-to-rear staggered positions.

Figure 21B:
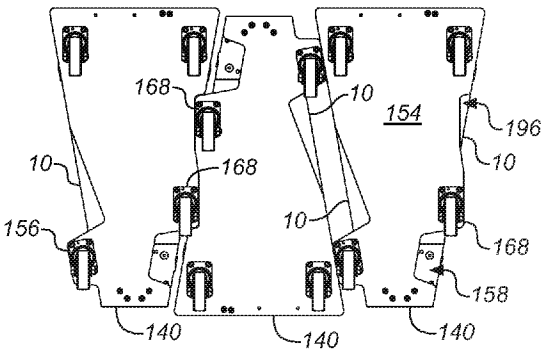

FIG. 21B is a bottom plan view of three dolly boards arranged to carry three speakers in the staggered positions shown in FIG. 21A.

DETAILED DESCRIPTION OF THE ILLUSTRATED EMBODIMENT

Figure 1A:
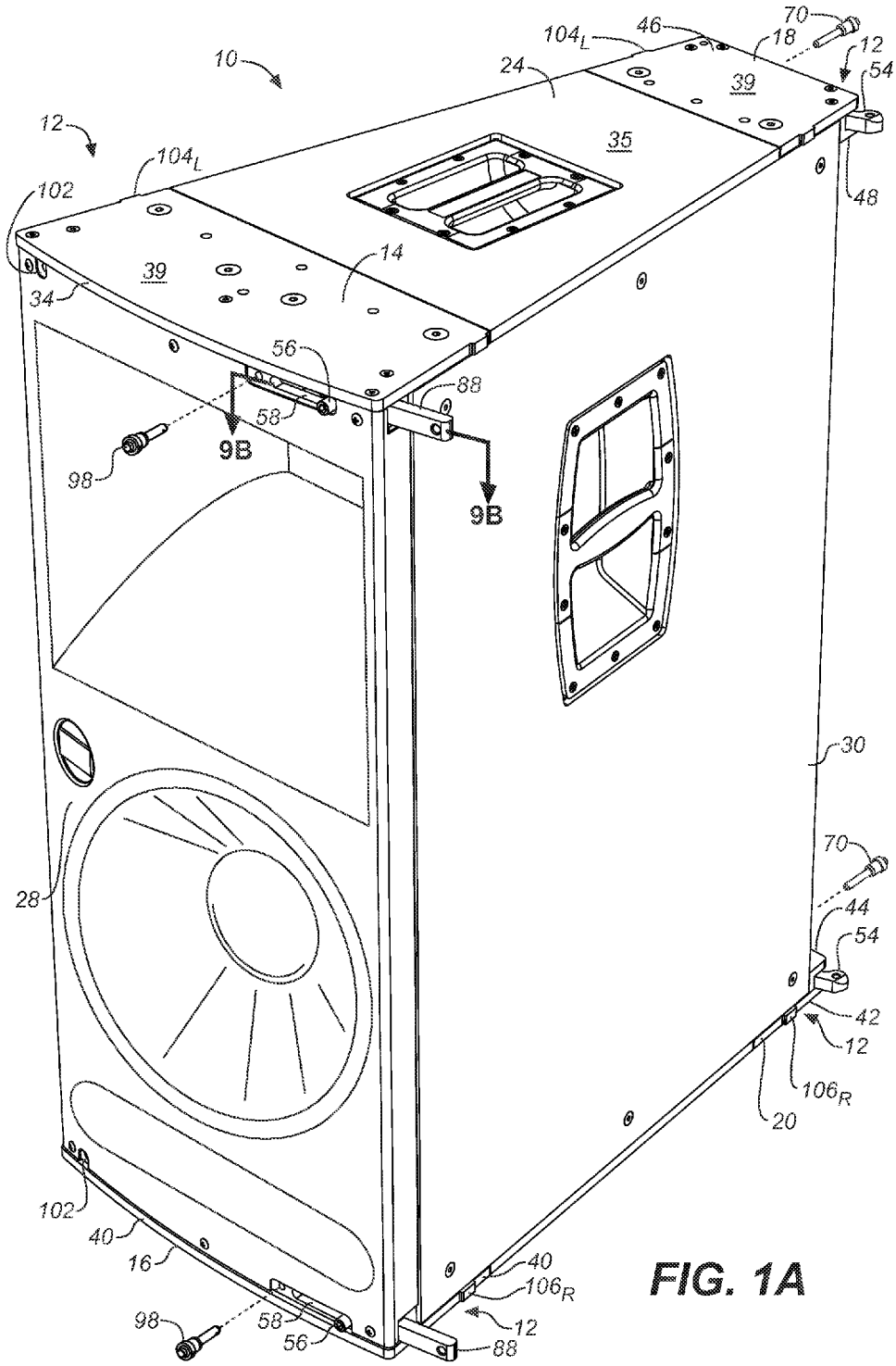
FIG. 1A is of an integrated rigging system according to the invention integrated into a loudspeaker showing links extending from each of the rigging structures for rigging the loudspeaker to an adjacent loudspeaker.
Figure 1B:
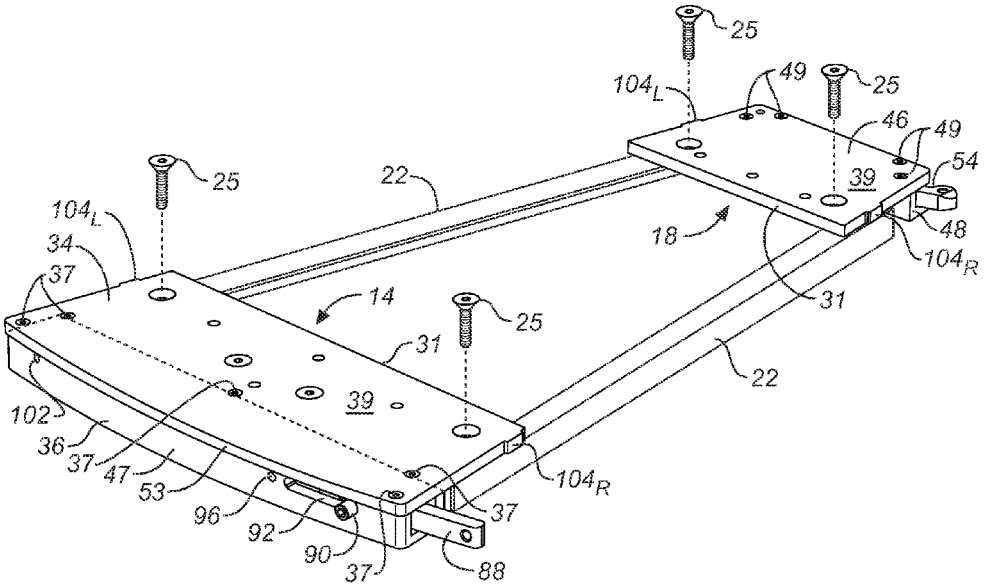
FIG. 1B is an upper perspective view of the integrated rigging system shown in FIG. 1 but where the sides of the loudspeaker's enclosure have been removed to reveal the rigid internal framework of the speaker box.
Figure 1B:
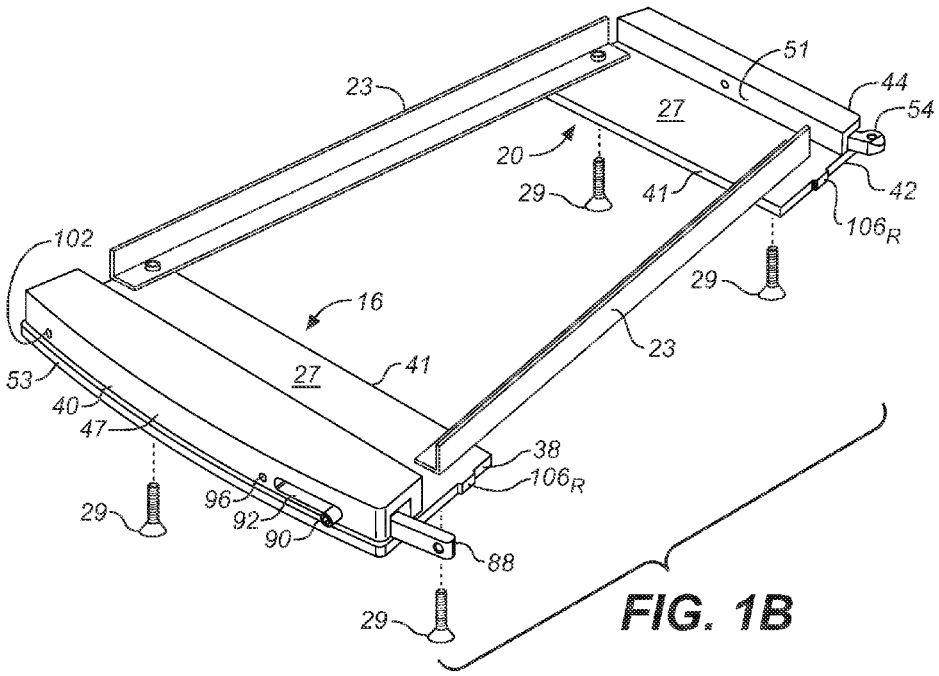

A loudspeaker 10 having an integrated rigging system 12 is shown in FIG. 1A. The integrated rigging system comprises top front 14, base front 16, top rear 18, and base rear 20 rigging structures. The rigging structures 14, 16, 18, 20 are firmly attached to the internal framework 22 of the loudspeaker as seen in FIG. 1B forming, respectively, the top front, base front, top rear and base rear portions of the enclosure of the loudspeaker. The enclosure is completed by attachment to the framework 22 of the top 24, bottom 26 (see FIG. 15), front 28, side 30, and back 32 (see FIG. 2) panels. It is contemplated that the primary plate and channel member of each rigging structure will be manufactured of aluminum or other structural material of at least equivalent strength, whereas the enclosure panels may be fabricated from wood or wood-based composites. By firmly securing the rigging structures 14, 16, 18, 20 to the framework, the loads created by linking multiple speakers in a vertical stack are carried by the strongest parts of the loudspeaker assembly. In particular, when multiple loudspeakers are linked together in a vertical stack, such as shown in FIG. 14 to be discussed in greater detail below, the load of loudspeakers suspended below each loudspeaker is primarily carried by rigging structures 14, 16, 18, 20. In the illustrated embodiment, front rigging structures 14, 16 are firmly attached to corresponding rear rigging structures 18, 20, respectively, by angle iron 22, 23 in effect creating top and bottom rigging assemblies which distribute loads on each of the top and base of each speaker in a vertical stack of loudspeakers between corresponding front and rear rigging structures. It is intended that additional rigid structural connections could be made between top and base structural members within the scope of the invention.

Each rigging structure is formed from a primary plate and a channel member attached to the interior surface of the primary member. Thus, as shown in FIG. 1B, top front rigging structure 14 is comprised of top front primary plate 34 joined to top front channel member 36 with fasteners 37, base front rigging structure 16 is formed from base front primary plate 38 joined to base front channel member 40 with fasteners 41 (see FIG. 15), base rear rigging structure 20 is formed from base rear primary plate 42 joined to base rear channel member 44 with fasteners 45 (also see FIG. 15), and top rear rigging structure 18 is formed from top rear primary plate 46 joined to top rear channel member 48 with fasteners 49. In the illustrated embodiment, the top rigging structures 14, 18 are interconnected by upper framing members 22 and base rigging structures 16, 20 are interconnected by lower framing members 23. The upper framing members 22 are affixed to the interior surface 27 of the top rigging structures 14, 18 with fasteners 25. Similarly, the lower framing members 23 are affixed to the base rigging structures 16, 20 with fasteners 29. The top panel 24 is attached to the upper framing members 22 and extends between the inner edges 31 of the top front and top rear primary plates 34, 46 such that the outer surface 35 of top panel 24 is in planar alignment with the exterior surfaces 39 of top front and top rear primary plates 34, 46. See FIGS. 1A and 1B. Similarly, the bottom panel 26 (see again FIG. 15) is attached to the lower framing members 23 and extends between the inner edges 41 of the base front and base rear primary plates 38, 42 such that the outer surface 43 of bottom panel 26 is in planar alignment with the exterior surfaces 57 of base front and base rear primary plates 38, 42 as shown. The enclosure of the loudspeaker is completed by attaching side panels 30 the upper and lower framing members 22, 23, affixing front panel 28 to the forward faces 47 of channel members 36, 40 of front rigging structures 14, 16, and by affixing back edge 49 (see FIG. 2) of back panel 32 to the inward faces 51 of channel members 44, 48 of rear rigging structures 18, 20. In this manner, front panel 28 is secured in flush alignment with the front edges 53 of the primary plates 34, 38 of front rigging structures 14, 16, and the back panel is inset from the rear faces 55 of the channel members 44, 48 of rear rigging structures 18, 20.

Figure 2:
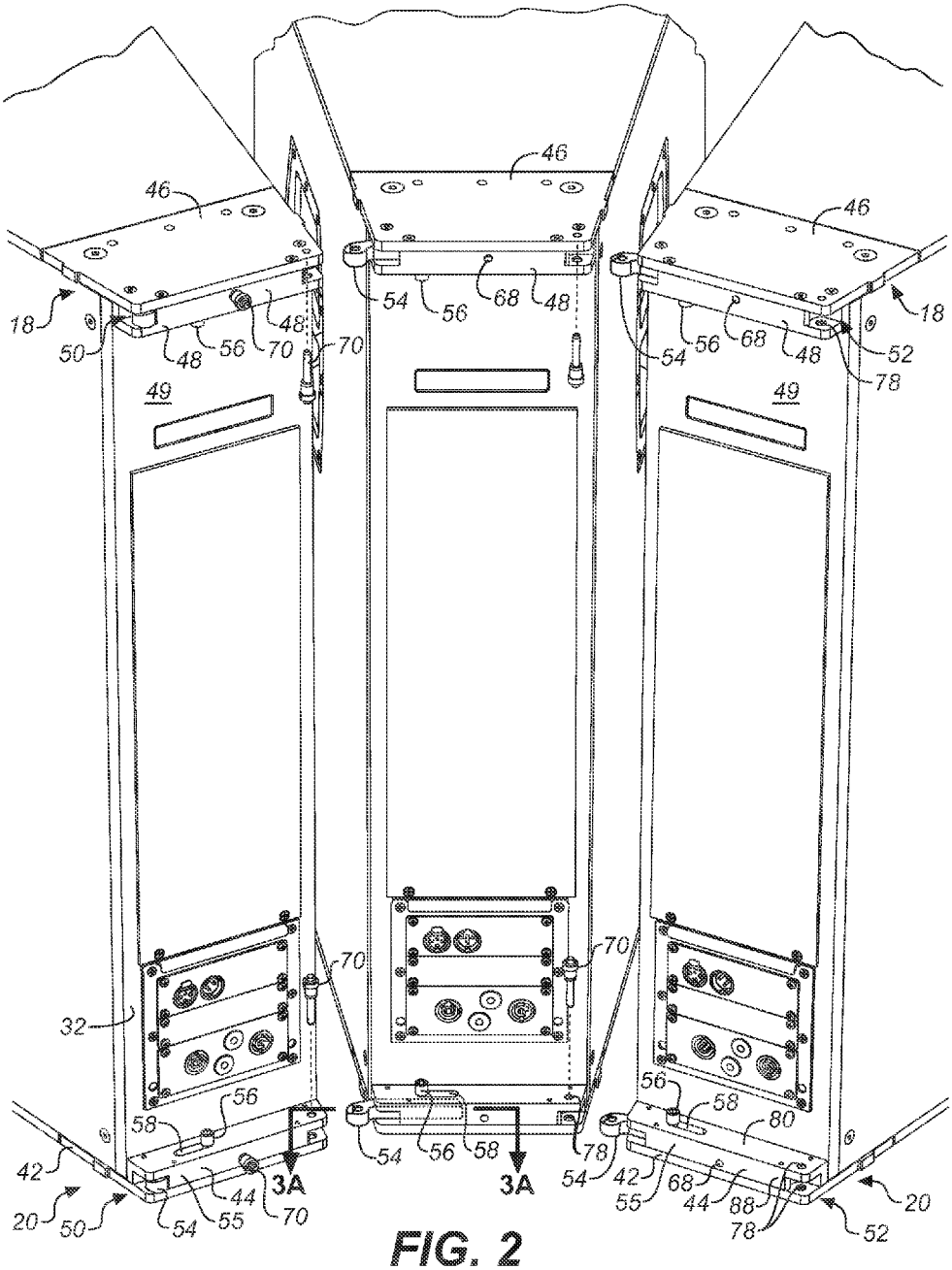
FIG. 2 is a rear perspective view of the integrated rigging system of three adjacent loudspeakers showing the rear links extending from the rightmost two loudspeakers.
Figure 2A:
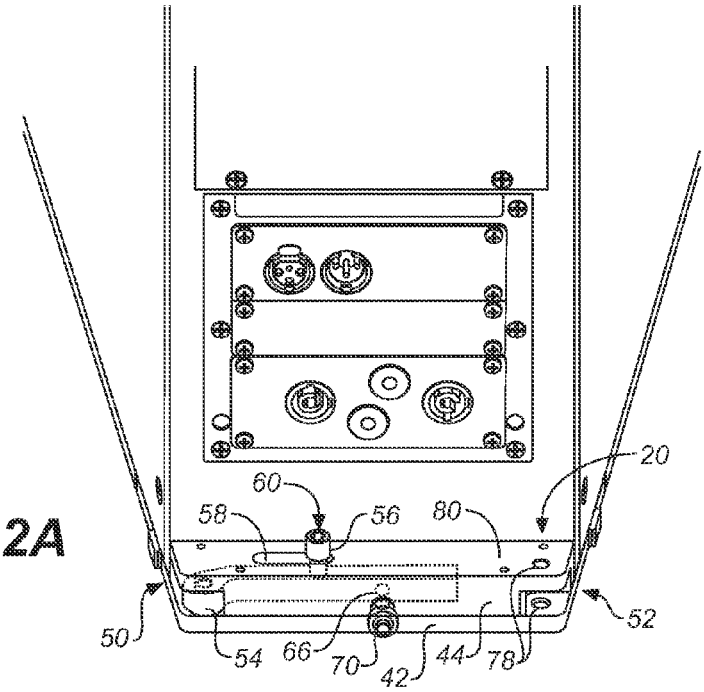
FIG. 2A is a close up upper perspective view of the bottom rear rigging structure of the integrated rigging system showing the rear link in the stowed position and the locking pin in the link pin stowing hole.
Figure 2B:
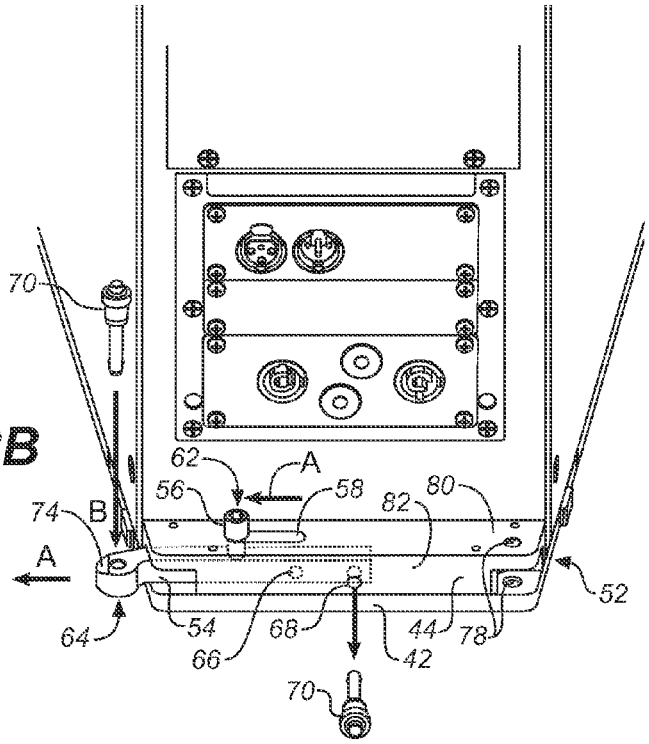
FIG. 2B is a close up upper perspective view of the bottom rear rigging structure of the integrated rigging system similar to FIG. 2A but showing the rear link extended to the deployed position, the locking pin removed from the link pin stowing hole.

Referring now to FIGS. 2, 2A, 2B, 3A, 3B and 7, link stowing channel 50 and link receiving slot 52 are formed in the base rear channel member 44 of the base rear rigging structure 20. Rear link 54 is slidably disposed in link stowing channel 50. Gripping knob 56 is attached to rear link 54 and is engaged in and movable along the length of guide slot 58. Thus, by gripping and moving gripping knob 56, rear link 54 can be moved in link stowing channel 50. In the embodiment illustrated in FIGS. 2A and 2B, by moving knob 56 to the rightmost extent 60 allowed by guide slot 58, link 54 is slid to a stowed position shown in FIG. 2A in which link 54 is fully received in link stowing channel 50. Conversely, moving knob 56 to the leftmost extent 62 allowed by guide slot 58, nearest the side of the rigging structure 44, translates link 54 to a deployed position in which an extended portion 64 of link 54 projects from the side of the rigging structure 20 as shown in FIG. 2B. When link 54 is positioned in the stowed position a locking pin stowing hole 66 in link 54 (see FIG. 2B) is brought into alignment with a cooperating locking pin stowing hole 68 in the base rear channel member 44 of the base rear rigging structure 20, as seen in FIGS. 2A and 3A, such that insertion of rear locking pin 70 in the aligned locking pin stowing holes 66, 68 secures the link 54 in the link stowing channel 50 in the stowed position. Hence, locking pin 70 must be removed from the locking pin stowing holes 66, 68, as seen in FIGS. 2B and 3A, to release link 54 so that it can be moved out of the stowed position as shown by arrow A in FIGS. 2B and 4.

FIG. 3A is a close up plan view of the base rear rigging structures of two of the three loudspeakers shown in FIG. 2 wherein the left link $\mathbf{54}_L$ is shown in the stowed position in the link stowing channel 50 of the left rigging structure 20 of the left loudspeaker, whereas the right link $\mathbf{54}_R$ of the right rigging structure 21 of the right loudspeaker is shown in the deployed position. FIG. 33 shows the left and right rigging structures 20 and 21 in abutting relation with the extended portion 64 of link $\mathbf{54}_R$ received in the link receiving slot 52 of the left rigging structure 20. In the illustrated embodiment, the extended portion 64 has a chamfered leading edge 72 (see FIG. 2B) to facilitate insertion of link 54 into link receiving slot 52, but it will be appreciated that the leading edge 72 could be formed with or without being chamfered or in a variety of other designs.

FIG. 3B shows rigging structures 20 and 21 in abutting relation with link $\mathbf{54}_R$ received in link receiving slot 52. But in the normal sequence of linking adjacent rigging structures, the rear portions of adjacent loudspeakers will be maneuvered together to bring rear adjacent corners 75 of the rear rigging structures 20, 21 together, as shown in FIGS. 5 and 6, whereupon link 55 of the right rigging structure 21 will be slid into the link receiving slot 54 of the left rigging structure 20. See FIGS. 3B and 4. In the deployed position the locking pin hole 76 of link 55 is brought into alignment with cooperating locking pin holes 78 of left rigging structure 20. Thereupon, link $\mathbf{54}_R$ is secured in link receiving slot 52 by insertion of locking pin 70 into the link's locking pin hole 76 and cooperating locking pin holes 78 of left rigging structure 20 as shown by arrow B in FIGS. 2B and 4. It will be seen by reference to FIGS. 2, 2A and 2B that gripping knob 56 and cooperating locking pin holes 78 are accessible on the horizontal top surface upper face 80 of the base rear channel member 44 and are thus inset from the back surface 82 of channel member 44. Therefore, when locking pin 70 is inserted into cooperating locking pin holes 78, both it and gripping knob 56 are inset from the back surface 82 of the rigging structure, as perhaps best understood in reference to FIG. 2, making a cleaner visual presentation when multiple speakers are linked together. It should be noted that locking pin 70 can be inserted into cooperating locking pin holes 78 from below and will work equally well to secure link 54 in link receiving slot 52, but such placement would leave pin 70 protruding from the bottom surface of base rear primary plate 42. This would make it problematic to place the loudspeaker on its bottom surface 26 to maneuver it next to an adjacent loudspeaker for interlinking.

The preceding discussion of the structure and operation of base rear rigging structure 20 is equally applicable to the top rear rigging structure 18 except that the top rear channel member 48 underlays the top rear primary plate 46 whereas the base rear channel member 44 overlays the base rear primary plate 42. Thus, the guide slot used for manipulation of gripping structure 56 is formed in a lower face of the top channel member 48. See FIG. 2. Hence locking pin 70 will normally be inserted in cooperating locking pin holes 78 from below as shown in FIG. 5. Similarly to the base rear rigging structure 20, locking pin 70 could be inserted in cooperating locking pin holes 78 from above to securely join two adjacent top rear rigging structures 18 whenever convenient, such as when another loudspeaker is not to be stacked on top of the loudspeaker being interlinked.

Interconnecting top and base rear rigging structures 18, 20 as described above links loudspeaker 10 with adjacent loudspeaker 10A in pivoting relation about a pivot axis P centered about and in parallel alignment with aligned locking pin holes 76, 78. See FIGS. 5, 6, 7 and 11. Hence, adjacent loudspeakers 10, 10A can be swiveled relative to each other, as indicated by arrow C in FIG. 6, from an open position in which the front rigging structures 14, 16 are separated, as shown in FIGS. 6 and 11, to a closed position in which they are in abutting relation as shown in FIG. 12. Thus, with reference again to FIG. 2, it is seen that multiple loudspeakers can be brought together on a suitable work surface and pinned together in an array.

With reference to FIGS. 8A, 8B, 9A, 9B, 10A and 10B, link stowing channels 84 and link receiving slots 86 are formed in each of the top and base front rigging structures 14, 16. Front links 88 are slidably disposed in link stowing channels 84. Gripping knobs 90 are attached to front links 88 and are engaged in and movable along the length of guide slots 92 formed in the forward faces 27 of the channel members 36, 40 of each of the front rigging structures 14, 16. By gripping and moving gripping knobs 90 to the side-adjacent end of guide slot 92, front links 88 can be moved in link stowing channels 84 from a stowed position, shown in FIGS. 8A and 9A, to a deployed position, shown in FIGS. 8B and 9B. In the stowed position, the locking pin stowing holes 94 of the front links 88, are brought into alignment with the cooperating locking pin stowing holes 96 provided in the front channel members 40, 44. Front links 88 are locked in the stowed position by insertion of locking pins 98 into the aligned locking pin stowing holes 94, 96. When front rigging structures are brought into direct abutment, locking pins 98 are removed from locking pin stowing holes 94, 96, as shown in FIGS. 8B and 9B, to release links 88 which are then slid to the deployed position and into the link receiving slots 86 of an adjacent loudspeaker. This brings the locking pin holes 100 provided in links 88 into alignment with the cooperating locking pin holes 102 which intersect the link receiving slots 86 in the front rigging structures of the adjacent loudspeaker. Thereupon links 88 may be secured in link receiving slots 86 by insertion of locking pins 98 in aligned locking pin holes 100, 102. See FIG. 10B.

By comparing FIGS. 2 and 11, it is seen that rear link pins 70 are inserted into locking pin holes 76, 78 vertically whereas front link pins 98 are inserted into lacking pin holes 100, 102 horizontally. Therefore, regardless of whether multiple loudspeakers are linked to form a horizontal array of loudspeakers, as shown in FIG. 12, or a vertical stack of loudspeakers, as shown in FIG. 14, at least two of the four links associated with each loudspeaker are positioned perpendicularly to vertical. This minimizes the chance of any two loudspeakers in a horizontal array or a vertical stack from separating in the unlikely event that a locking pin fails.

Commercially available quick release pins can be used to pin both the front and rear rigging structures. A suitable quick release pin a single acting positive locking pin having a corrosion resistant steel spindle such as that manufactured by Jergens, Inc. of Cleveland, Ohio. A suitable quick release pin (not illustrated in detail) has an elongated steel spindle with a leading chamfered end and a gripping end. A thumb actuated, depressible release button activates an internal spring release mechanism which permits detente balls to be retracted when the pin is pressed through the locking pin holes and locking pin stowing holes in the rigging structures and links. With the pin inserted, release of the button will cause the quick release pin to lock into place.

In the illustrated embodiment, speakers linked together in vertical stacks or horizontal arrays will have an angular splay of approximately twenty degrees. It will be readily understood however that the integrated rigging system described herein may be applied to other loudspeaker arrays wherein adjacent loudspeakers are linked together at relative angles other than twenty degrees.

Referring once again to FIGS. 3B, 6, 10A and 10B, the primary plates of each rigging structure are provided with locator tabs 104, 106 on each side of each rigging structure positioned so that when corresponding rigging structures from adjacent loudspeakers are put in abutting relation, maneuvering the locator tabs into overlapping side-to-side abutment places the front and rear edges of the loudspeaker into alignment. Locator tabs are organized into nesting pairs such that the locator tabs $\mathbf{104}_R$ provided on the right sides of the front and rear top rigging structures 14, 18 nest inside of the locator tabs $\mathbf{104}_L$ provided on the left sides of the front and rear top rigging structures 14, 18, and the locator tabs $\mathbf{106}_L$ provided on the left sides of the front and rear base rigging structures 16, 20 nest inside the locator tabs $\mathbf{106}_R$ provided on the right sides of the front and rear base rigging structures 16, 20. Furthermore, the locator tabs on each side of each rigging structure are offset from the locator tab on the vertically corresponding rigging structure creating a unique interlocking arrangement. For example, as seen in FIG. 3B, the top right locator tab $\mathbf{104}_R$ is offset inward relative to the base right locator tab $\mathbf{106}_R$, and the top left locator tab $\mathbf{104}_L$ is offset rearward relative to the base left locator tab $\mathbf{106}_L$. Thus, the only arrangement of the locator tabs that results in each tab being placed in side-to-side abutment with the locator tabs of an abutting loudspeaker, also places the loudspeakers in precise forward-to-back alignment. In the illustrated embodiment, that arrangement places locator tabs $\mathbf{104}_R$ on the top right of the front and rear top rigging structures 14, 18 inward of locator tabs $\mathbf{104}_L$ on the top left of the front and rear top rigging structures 14, 18, and places locator tabs $\mathbf{106}_R$ on the right of the front and rear base rigging structures 16, 20 outward of locator tabs $\mathbf{106}_L$ on the left of the front and rear base rigging structures 16, 20. It will appreciated that these pairings could be rearranged or reversed to provide a similar interlocking nesting relationship.

FIG. 12 shows a horizontal array of five loudspeakers 10 linked together using the integrated rigging system described above. Horizontal arrays of loudspeakers may be picked up for overhead deployment using pickup plates 109. In the illustrated configuration each pickup plate is attached to one loudspeaker and the other loudspeakers in the array are supported by interlinking of the loudspeakers through the integrated rigging system to the loudspeakers connected directly to the pickup plates. Thus, horizontal loads are transmitted through and borne by the rugged top and base rigging structures. In another configuration, each pickup plate 109 can be shifted laterally so that it straddles the seam between two abutting loudspeakers. Thus, each pickup plate 109 would be used to support two adjoining loudspeakers. For example, up to as many as four pickup plates 109 could be used to pick up the array of five loudspeakers shown in FIG. 12, each pickup plate straddling two speakers.

Figure 13A:
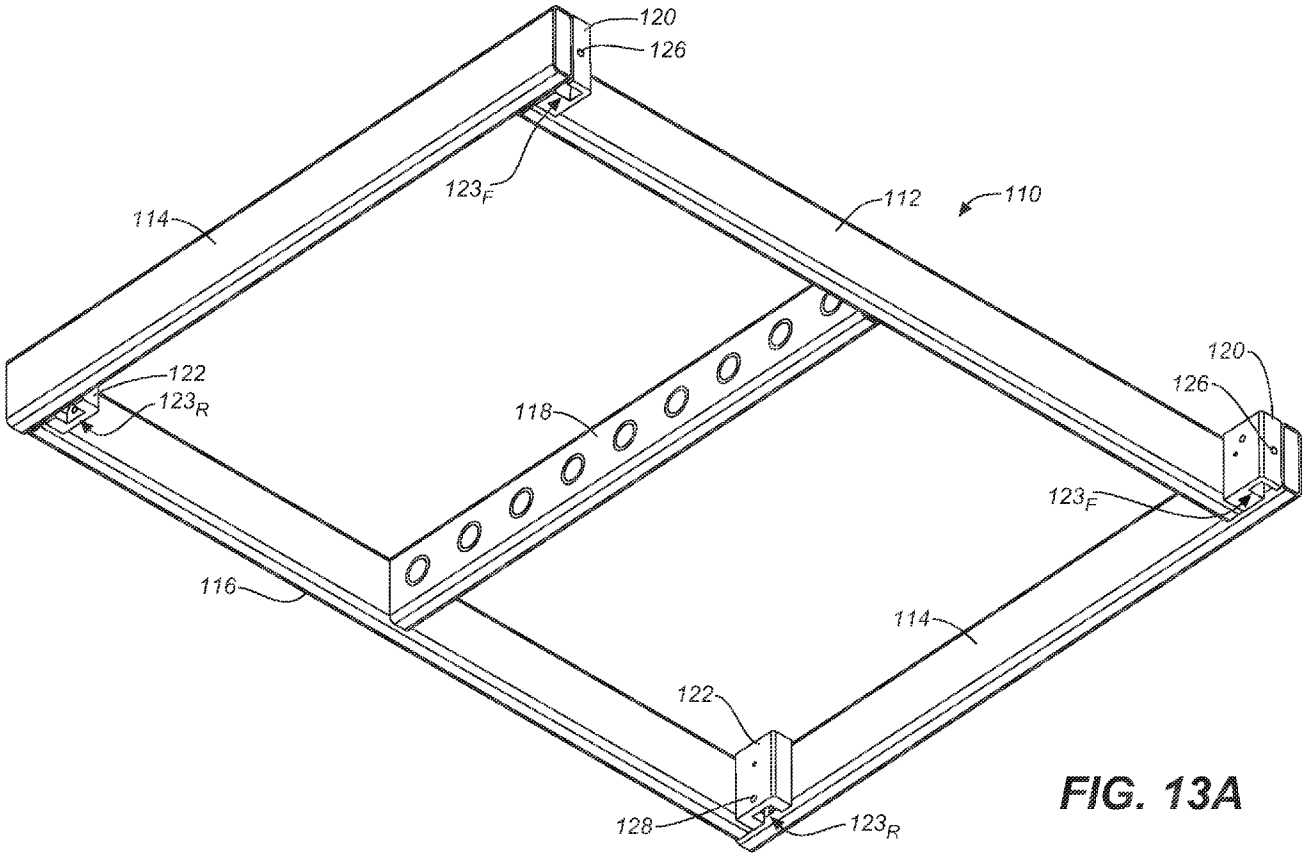

With reference now to FIGS. 13, 13A and 14, a top lifting grid 110 comprises a front frame member 112, side frame members 114, a rear frame member 116, and a center bridge frame member 118. The front, side, rear, and center bridge frame members are suitably fabricated of rectangular steel tubing welded into a frame as shown. At each of the intersections of the front and side frame members 112, 114 a front link receiving structure 120 is provided for receiving front links 88. And at each of the intersections of the side and rear frame members 114, 116, a rear link receiving structure 122 is provided for receiving rear links 54. Forward and rear top lifting grid link receiving slots $\mathbf{123}_F$, $\mathbf{123}_R$ are provided in each of the front and rear link receiving structures 120, 122 for receiving the front and rear links 88, 54 for linking the top lifting grid 110 to the topmost loudspeaker 124 in a vertical stack of loudspeakers. Front locking pin holes 126 oriented perpendicularly to the front 28 of the loudspeaker are provided in front link receiving structures 120. Rear locking pin holes 128 oriented perpendicularly to the top and bottom 24, 26 (see also FIG. 15) of the loudspeaker are provided in rear link receiving structures 122. In practice, once the top lifting grid 110 is positioned over the topmost loudspeaker 124, the front and rear links 88, 54 are deployed into the link receiving slots and then front and rear locking pins 98, 70 are inserted into front and rear locking pin holes 126, 128 and the aligned locking pin holes 100, 76 of links 88, 54, respectively.

FIG. 16 shows a dolly board 140 for carrying a loudspeaker 10 having an integrated rigging system according to the invention as shown in FIGS. 17-18. The dolly board 140 comprises board 142 having an overall trapezoidal configuration as shown in FIG. 16, and having a front end 144, a rear end 146, a right side 148, a left side 150, a top surface 152 and a bottom surface 154 (see FIG. 20B). The trapezoidal configuration generally conforms to the horizontal profile of the loudspeaker 10 as shown in FIGS. 17-18. The left side 150 has a protrusion 156 near the rear end 146 and the right side has a recess 158 correspondingly shaped so that the protrusion 156 of another adjacent dolly board is snugly received in the recess 158, as shown in FIG. 20B, and so that the front and rear edges 160, 162 of the protrusion 156 are brought into abutting relation with the front and rear side walls 164, 166 of the recess 158. So configured, the front and rear ends 144, 146 of the adjacent dollies are closely aligned and, since the protrusion 156 is captured in the recess 158, its front and rear edges 160, 162 restrict the dolly board from drifting forward or backward with respect to the adjacent dolly board.

In addition to protrusion 156, each dolly board 140 has an outwardly extended portion 168 forward of recess 158 and a cut out section 170 shaped to receive the extended portion 168 of another adjacent dolly board. See again FIG. 20B. Rear wheels 172 are attached to the bottom surface 154 of the dolly board under the protrusion 156 and the extended portion 168 to provide a wider lateral wheel base near the rear end 146 of the dolly board than would otherwise be possible. Accordingly, the rear wheel base is almost the same width as the front wheel base established by the two front wheels 174 mounted under the front end 144. The dolly board 140 thus provides a convenient and stable wheeled platform for maneuvering loudspeakers into adjacency such as is seen in FIG. 19.

Referring also to FIG. 15, orientation strips 176 are fitted to the bottom surfaces of the front and rear rigging structures 16, 20. The orientation strips 176 fit in front orientation slot 178 and rear orientation slots 180, 182 shown in FIG. 16 to assist in properly orienting a loudspeaker 10 being placed on a dolly board 140. Rear orientation slots 180 and 182 cooperate when two dolly boards are brought into abutting relation to receive the rear orientation strip.

A forward abutment 184 on the front end 144 of the dolly board 140, and dual rear abutments 193 mounted on the rear end 146 of the dolly board, provide forward and backward lateral support for a loudspeaker 10. See FIGS. 16, 17 and 18. A forward bracket 188 is mounted on the front end 144 of the dolly board adjacent forward abutment 184 and is positioned so that, when a loudspeaker is placed on dolly board 140, a forward bracket locking pin hole 190 in the vertical portion of the bracket aligns with locking pin stowing hole 66 (see, e.g., FIG. 1A) in the base front channel member 40 of the loudspeaker, whereupon the front end 144 of the dolly board 140 may be pinned to the loudspeaker 10 by insertion of a forward locking pin 98 through forward bracket locking pin hole 190 into the locking pin stowing hole 66 as shown in FIG. 17. Similarly, a rear bracket 186 is mounted on the rear end 146 of the dolly board 140 between dual rear abutments 193 and is positioned so that, when a loudspeaker is placed on the dolly board 140, a rear bracket locking pin hole 192 in the vertical portion of rear bracket 186 aligns with locking pin stowing hole 68, whereupon the rear end 146 of the dolly board 140 can be pinned to the rear of the loudspeaker by insertion of a rear locking pin 70 through rear bracket locking pin hole 192 into locking pin stowing hole 68 (see, e.g., FIG. 2B) as shown in FIG. 18. It is, therefore, quick and easy to place a loudspeaker 10 on a dolly board 140 and pin the dolly board to the loudspeaker to enable loudspeakers to be maneuvered much more easily than moving them about on a floor. In this fashion, multiple loudspeakers may be positioned in side-to-side abutment and linked together as shown in FIG. 19. Conversely, one or more dolly boards 140 can easily be lifted up and attached to the bottom surfaces of one or more loudspeakers in a suspended horizontal array of loudspeakers such as that shown in FIG. 12. The array can then be lowered onto a surface and rolled away to a more convenient location. The wear strips 194 shown in FIG. 16 may be optionally added to improve the life of the dolly board 140.

Three loudspeakers 10, each resting on a dolly board 140, are shown arranged into a horizontal array in FIG. 20A. FIG. 20B is a bottom plan view of the three dolly boards 140 underlying the array of loudspeakers 10 shown in FIG. 20A showing protrusions 156 nested in recessed 158 and extended portions 168 received in cut-out sections 170. Using a plurality of dolly boards 140, horizontal arrays of linked loudspeakers can easily be rolled into position for onsite deployment according to differing venues.

FIG. 21A is a top plan view showing three loudspeakers arranged side-by-side in a staggered front-to-back arrangement on three dolly boards 140. This orientation provides a more compact grouping of multiple loudspeakers achieved in part by cooperative nesting of extended portions 168 in indented sections 196 of the two leftmost dolly boards and by the overall more compact arrangement realized by staggering the wedge shapes of the dolly boards 140.

An integrated rigging system for loudspeakers and loudspeaker containing the same has the advantage that all the component parts for rigging arrays of loudspeakers are fully integrated into the structure of each loudspeaker. This reduces inventory tracking requirements, minimizes lost parts, and speeds up the process of linking adjoining speakers. By internalizing links into the structure, the top and bottom surfaces of each speaker are flat and free of protruding links, thereby making it feasible and much more efficient to rig an array of loudspeakers directly on a flat surface or using dolly boards.

While the present invention of an integrated rigging system for loudspeakers and loudspeaker containing same is described in considerable detail in the foregoing specification, it is not intended that the invention be limited to such detail except as necessitated by the following claims.

What is claimed is:

1. An integrated rigging system for a loudspeaker for interconnecting the loudspeaker with other loudspeakers in abutting relation, the integrated rigging system comprising:

rigging structures comprising front rigging structures and rear rigging structures, said front rigging structures including a top front rigging structure and a base front rigging structure, and said rear rigging structures including a top rear rigging structure and a base rear rigging structure, each of said rigging structures including a primary plate having an exterior surface, an interior surface, and an inner edge, framing members including two upper framing members and two lower framing members, said upper framing members affixed to the interior surface of and interconnecting the primary plates of said top front and top rear rigging structures, said lower framing members affixed to the interior surface of and interconnecting the primary plates of said base front and base rear rigging structures, enclosure panels including a top panel, a bottom panel, a front panel, a back panel and opposite side panels, each of said top and bottom panels having an outer surface, said top panel affixed to said upper framing members, said top panel extending between the inner edges of the primary plates of said top front and top rear rigging structures, the outer surface of said top panel in planar alignment with the exterior surfaces of the primary plates of said top front and top rear rigging structures, said bottom panel affixed to said lower framing members, said bottom panel extending between the inner edges of the primary plates of said base front and base rear rigging structures, the outer surface of said bottom panel in planar alignment with the exterior surfaces of the primary plates of said base front and base rear rigging structures, said side panels extending between and interconnecting said upper and lower framing members, said front panel extending between and interconnecting the primary plates of said top front and base front rigging structures, said back panel extending between and interconnecting the primary plates of said top rear and base rear rigging structures, said rigging structures, framing members and enclosure panels forming an enclosure for the loudspeaker, wherein said rigging structures are integrated into the enclosure of the loudspeaker, and a plurality of links, each link extendable from one of said rigging structures for linking said rigging structure with a corresponding rigging structure of the enclosure of an adjacent loudspeaker.

2. The integrated rigging system for a loudspeaker of claim 1 wherein:

each of said rigging structures includes a channel member affixed to the interior surface of said primary plate, each of said links disposed in one of said channel members.

3. The integrated rigging system for a loudspeaker of claim 2 wherein:

each of the primary plates of said front rigging structures has a front edge, and each of the channel members of said front rigging structures has a forward face, said front panel extending between and interconnecting the forward faces of the channel members of said top front and base front rigging structures such that said front panel is flush with the front edges of the primary plates of said front rigging structures.

4. The integrated rigging system for a loudspeaker of claim 2 wherein:

each of the primary plates of said rear rigging structures has a back edge, and each of the channel members of said rear rigging structures has an inward face and a rear face, said back panel extending between and interconnecting the channel members of said top rear and base rear rigging structures, wherein said back panel is in abutting relation with the inward faces of the channel members of said rear rigging structures, and the rear faces of the channel members of said rear rigging structures are flush with the back edges of the primary plates of said rear rigging structures, such that said back panel is inset from the rear faces of the channel members of said rear rigging structures.

5. The integrated rigging system for a loudspeaker of claim 2 wherein:

each of said rigging structures has two opposite sides, a link stowing channel in one of said sides, and a link receiving slot in the other of said sides, one of said links slidingly disposed in the link stowing channel of each of said rigging structures and movable from a stowed position to a deployed position, in the stowed position each link retracted inside the link stowing channel, and in the deployed position a portion of each link projecting from the side of said rigging structure for insertion into the link receiving slot of a corresponding rigging structure of the enclosure of an adjacent loudspeaker, a hand accessible gripping structure is associated with each link which can be gripped to move said link by hand between the stowed and deployed positions, the channel members of said front rigging structures each include a forward face in parallel disposition to said front panel, said forward face having a guide slot, the channel member of said top rear rigging structure has a lower face perpendicular to said back panel, said lower face having a guide slot, the channel member of said base rear rigging structure has an upper face perpendicular to said back panel and opposite the lower face of said top rear rigging structure, said upper face having a guide slot, each gripping structure engaging the guide slot of the channel member of one of said rigging structures and movable along the length thereof for sliding each link in the link stowing channel.

6. The integrated rigging system for a loudspeaker of claim 5 wherein:

each guide slot has a side-adjacent end, wherein moving the gripping structure against the side-adjacent end positions each link in said deployed position.

7. The integrated rigging system for a loudspeaker of claim 5 further comprising:

a plurality of locking pins, each of the locking pins associated with one of said rigging structures, each link having a locking pin stowing hole, each of said rigging structures having a cooperating locking pin stowing hole intersecting said link stowing channel, wherein when each link is in said stowed position, the locking pin stowing hole is aligned with the cooperating locking pin stowing hole, such that insertion of said locking pin in said locking pin stowing hole and said cooperating locking pin stowing hole secures said link in the stowed position in the link stowing channel.

8. The integrated rigging system for a loudspeaker of claim 5 further comprising:

a plurality of locking pins, each of said locking pins associated with one of said rigging structures, each link having a locking pin hole, and each of said rigging structures having a cooperating locking pin hole intersecting said link receiving slot, said cooperating locking pin hole associated with each of said forward rigging structures intersecting the forward face of the channel members thereof, said cooperating locking pin hole associated with said top rear rigging structure intersecting the lower face of the channel member thereof, and said cooperating locking pin hole associated with said base rear rigging structure intersecting the upper face of the channel member thereof, wherein when each link is in the deployed position and is inserted in the link receiving slot of a corresponding rigging structure of the enclosure of an adjacent loudspeaker, the locking pin hole aligns with the cooperating locking pin hole of the link receiving slot of said corresponding rigging structure so that insertion of said locking pin in said locking pin hole and said cooperating locking pin hole secures said link in the link receiving slot and locks the rigging structure in abutting relation with said corresponding rigging structure.

9. The integrated rigging system for a loudspeaker of claim 8 wherein:

said plurality of links including a plurality of rear links, each rear link associated with one of said rear rigging structures, each rear link having a rear link locking pin hole, each of said rear rigging structures having a cooperating locking pin hole, said plurality of locking pins includes at least one rear locking pin associated with each of said rear rigging structures, and said rear link locking pin holes and said cooperating locking pin holes of said rear rigging structures are disposed vertically, such that when the rear link locking pin hole of one of the rear links and a cooperating locking pin hole of a corresponding rear rigging structure of an adjacent loudspeaker are aligned, insertion of one of the rear locking pins in said rear link locking pin hole and in said cooperating locking pin hole links the rear rigging structure with said corresponding rear rigging structure in pivoting relation about a vertical pivot axis.

10. The integrated rigging system for a loudspeaker of claim 9, the loudspeaker enclosure having two sides, wherein:

the enclosure is movable about said pivot axis to bring one of the sides into abutting relation with one of the sides of the enclosure of an adjacent loudspeaker for linking the front rigging structures to corresponding front rigging structures of the enclosure of the adjacent loudspeaker.

11. The integrated rigging system for a loudspeaker of claim 5 further comprising:

a top lifting grid for engaging and lifting a vertical stack of loudspeakers, the top lifting grid having a plurality of top lifting grid link receiving slots for receiving the plurality of links of each of the rigging structures of the enclosure of the topmost loudspeaker in a vertical stack of loudspeakers, each of said links having a locking pin hole, a plurality of top lifting grid locking pin holes, each of said top lifting grid locking pin holes intersecting one of said top lifting grid link receiving slots, a plurality of locking pins associated with the top lifting grid, wherein when said plurality of links are in the deployed position and are inserted in the plurality of top lifting grid link receiving slots, the locking pin hole of each of said links aligns with one of said plurality of top lifting grid locking pin holes, so that insertion of said plurality of locking pins in the locking pin holes of said links and in said top lifting grid locking pin holes secures said links in said plurality of top lifting grid link receiving slots to lock the rigging structures of the enclosure of the topmost loudspeaker to the top lifting grid.

12. The integrated rigging system for a loudspeaker of claim 1, the enclosure of the loudspeaker also having front and rear ends and left and right sides, the integrated rigging system further comprising:

each of said rigging structures having a right edge and a left edge opposite said right edge, said right edge in planar alignment with the right side of the enclosure and said left edge in planar alignment with the left side of the enclosure, a right locator tab projecting from said right edge, a left locator tab projecting from said left edge, each of said right and left locator tabs having a forward edge, a rear edge, and an outer contact face, one of said right and left locator tabs set forward of the other of said right and left locator tabs, wherein when one of the left and right sides of the enclosure of the loudspeaker is positioned in abutting relation with one of the left and right sides of the enclosure of an adjacent loudspeaker with the front ends and the back ends of the loudspeaker and the adjacent loudspeaker aligned, the forward edge of one of said right and left locator tabs of each of said rigging structures of the enclosure is in abutting relation with the rear edge of the other of said right and left locator tabs of the corresponding rigging structure of said adjacent loudspeaker, the contact face of said one of said right and left locator tabs of each of said rigging structures is engaged with one of the left and right sides of the corresponding rigging structure of said adjacent loudspeaker, and one of the left and right edges of each of said rigging structures is engaged with the contact face of the other of said right and left locator tabs of the corresponding rigging structure of said adjacent loudspeaker, such that said right and left locator tabs provide reference points for use in positioning said rigging structures of the enclosure of the loudspeaker in forward-to-rear alignment with the corresponding rigging structures of the enclosure of the adjacent loudspeaker for alignment of the front and rear ends of the loudspeakers.

13. The integrated rigging system for a loudspeaker of claim 1 further comprising:

a top lifting grid for engaging and lifting a vertical stack of loudspeakers, the top lifting grid having a plurality of top lifting grid link receiving slots for receiving the plurality of links of each of the rigging structures of the enclosure of the topmost loudspeaker in a vertical stack of loudspeakers.

14. An integrated rigging system for a loudspeaker for interconnecting the loudspeaker with other loudspeakers in abutting relation, the loudspeaker having an internal framework and a surrounding enclosure, the enclosure having top front, top rear, base front and base rear portions, said integrated rigging system comprising:

rigging structures comprising front rigging structures and rear rigging structures, said front rigging structures including a top front rigging structure and a base front rigging structure, and said rear rigging structures including a top rear rigging structure and a base rear rigging structure, said rigging structures for mounting to the framework for forming the top front, base front, top rear and base rear portions of the enclosure, each of said rigging structures having two opposite sides, a link stowing channel link in one of said sides, and a link receiving slot in the other of said sides, a plurality of links, one of said links slidingly disposed in the link stowing channel of each of said rigging structures and movable from a stowed position to a deployed position, in the stowed position each link retracted inside the link stowing channel, and in the deployed position a portion of each link projecting from the side of said rigging structure for insertion into the link receiving slot of a corresponding rigging structure of the enclosure of an adjacent loudspeaker for linking said loudspeaker with said adjacent loudspeaker, said plurality of links including a plurality of front links and a plurality of rear links, each of said front links associated with one of said front rigging structures, each of said rear links associated with one of said rear rigging structures, each of said front links having a front link locking pin hole, and each of said front rigging structures having a front rigging structure cooperating locking pin hole, said front link locking pin holes and said front rigging structure cooperating locking pin holes disposed horizontally, each of said rear links having a rear link locking pin hole, each of said rear rigging structures having a cooperating locking pin hole, said rear link locking pin holes and said cooperating locking pin holes of said rear rigging structures disposed vertically, a hand accessible gripping structure associated with each link which can be gripped to move said link by hand between the stowed and deployed positions, a guide slot adjacent said link stowing channel, said gripping structure engaging said guide slot and movable along the length thereof for sliding each link in the link stowing channel, and a plurality of locking pins, each of said locking pins associated with one of said rigging structures, said plurality of locking pins including at least one rear locking pin associated with each of said rear rigging structures, when the rear link locking pin hole of one of the rear links and a cooperating locking pin hole of a corresponding rear rigging structure of an adjacent loudspeaker are aligned, insertion of one of the rear locking pins in said rear link locking pin hole and in said cooperating locking pin hole links the rear rigging structure with said corresponding rear rigging structure in pivoting relation about a vertical pivot axis, wherein when each link is in the deployed position and is inserted in the link receiving slot of a corresponding rigging structure of the enclosure of an adjacent loudspeaker, the locking pin hole aligns with the cooperating locking pin hole of the link receiving slot of said corresponding rigging structure so that insertion of said locking pin in said locking pin hole and said cooperating locking pin hole secures said link in the link receiving slot and locks the rigging structure in abutting relation with said corresponding rigging structure.

15. An integrated rigging system for a loudspeaker for interconnecting the loudspeaker with other loudspeakers in abutting relation, the loudspeaker having a trapezoidal profile, an internal framework and a surrounding enclosure, the enclosure having top front, top rear, base front and base rear portions, said integrated rigging system comprising:

rigging structures comprising front rigging structures and rear rigging structures, said front rigging structures including a top front rigging structure and a base front rigging structure, and said rear rigging structures including a top rear rigging structure and a base rear rigging structure, said rigging structures for mounting to the framework for forming the top front, base front, top rear and base rear portions of the enclosure, and a plurality of links, each link extendible from one of the rigging structures for linking said rigging structure with a corresponding rigging structure of the enclosure of an adjacent loudspeaker, and a wheeled dolly board for carrying the loudspeaker, the dolly board having left and right sides, front and rear ends, and a generally trapezoidal configuration for conforming to the profile of the loudspeaker, the front end being wider than the rear end, the left side having a protrusion adjacent the rear end, the protrusion having a forward edge and a rearward edge, the right side having a recess shaped generally to receive the protrusion of an adjacent dolly board, wherein when the dolly board is placed in sideways abutment with an adjacent dolly board with the front and rear ends of the dolly boards aligned, the protrusion is snugly received in the recess of the adjacent dolly board, and the forward and rear edges restrict the dolly board from forward-to-back movement relative the adjacent dolly.

16. The integrated rigging system for a loudspeaker of claim 15 further comprising:

the right side having an outwardly extended portion forward of the recess, the left side having a cut out shaped to receive the extended portion of an adjacent dolly board, wherein when the dolly board is placed in said sideways abutment with an adjacent dolly board, the extended portion of the adjacent dolly board is received in the cut out.

17. The integrated rigging system for a loudspeaker of claim 16 further comprising:

a first wheel depending from the protrusion on the left side, and a second wheel depending from the extended portion on the right side, such that the first and second wheels provide a transverse wheel base near the rear end wider than the width of the loudspeaker directly above the first and second wheels.

18. The integrated rigging system for a loudspeaker of claim 16 further comprising:

the base front and base rear rigging structures each having a bottom surface, a front orientation strip attached to the bottom surface of the base front rigging structure, and a rear orientation strip attached to the bottom surface of the base rear rigging structure, and the dolly board including a top surface having a front orientation slot and a plurality of rear orientation slots, the front orientation slot for receiving the front orientation strip of a loudspeaker placed on the dolly board, the rear orientation slots including a right rear orientation slot and a left rear orientation slot, the right rear orientation slot opening into said recess, the left rear orientation slot formed in said protrusion and open on a left face of said protrusion, the left rear and right rear orientation slots cooperating when two dolly boards are placed in abutting relation to form a continuous rear orientation slot for receiving the rear orientation strip of the loudspeaker.

19. The integrated rigging system for a loudspeaker of claim 16 further comprising:

the dolly board having a front end, a top surface, and a forward abutment on the top surface near the front end for providing lateral support for a loudspeaker placed on the dolly board.

20. The integrated rigging system for a loudspeaker of claim 16 further comprising:

said base front and base rear rigging structures each having a locking pin stowing hole, and the dolly board having a front end, a rear end, a top surface, a forward bracket mounted on the top surface near the front end, and a rear bracket mounted on the top surface near the rear end, the forward bracket having a forward bracket locking pin hole for aligning with the locking pin stowing hole in the base front rigging structure of a loudspeaker positioned on the dolly board, and the rear bracket having a rear bracket locking pin hole for aligning with the locking pin stowing hole in the base rear rigging structure of the loudspeaker, wherein the dolly board can be pinned to the loudspeaker by insertion of a first locking pin through the forward bracket locking pin hole into the locking pin stowing hole of the base front rigging structure and a second locking pin through the rear bracket locking pin hole into the locking pin stowing hole of the base rear rigging structure.

21. The integrated rigging system for a loudspeaker of claim 20 wherein:

said rear bracket includes a lower portion and an upper portion having a horizontal section, the lower portion mounted to the dolly board, the upper portion hingedly connected to the lower portion and movable to and away from a raised position in which the horizontal section overlaps the base rear rigging structure.

22. An integrated rigging system for a loudspeaker for interconnecting the loudspeaker with other loudspeakers in abutting relation, the integrated rigging system comprising:

rigging structures comprising front rigging structures and rear rigging structures, said front rigging structures including a top front rigging structure and a base front rigging structure, and said rear rigging structures including a top rear rigging structure and a base rear rigging structure, each of said rigging structures including a primary plate and a channel member, said primary plate having an exterior surface, an interior surface, and an inner edge, said channel member affixed to the interior surface of said primary plate, each of the primary plates of said front rigging structures having a forward edge, each of the channel members of said front rigging structures having a forward face, each of the primary plates of said rear rigging structures having a back edge, each of the channel members of said rear rigging structures having an inward face and a rearward face, framing members including two upper framing members and two lower framing members, said upper framing members affixed to the interior surface of and interconnecting the primary plates of said top front and top rear rigging structures, said lower framing members affixed to the interior surface of and interconnecting the primary plates of said base front and base rear rigging structures, enclosure panels including a top panel, a bottom panel, a front panel, a back panel and opposite side panels, each of said top and bottom panels having an outer surface, said top panel affixed to said upper framing members, said top panel extending between the inner edges of the primary plates of said top front and top rear rigging structures, the outer surface of said top panel in planar alignment with the exterior surfaces of the primary plates of said top front and top rear rigging structures, said bottom panel affixed to said lower framing members, said bottom panel extending between the inner edges of the primary plates of said base front and base rear rigging structures, the outer surface of said bottom panel in planar alignment with the exterior surfaces of the primary plates of said base front and base rear rigging structures, said side panels extending between and interconnecting said upper and lower framing members, said front panel extending between and interconnecting the channel members of said top front and base front rigging structures, said front panel flush with the forward edges of the primary plates of said front rigging structures, said back panel extending between and interconnecting the channel members of said top rear and base rear rigging structures, the rearward faces of the channel members of said rear rigging structures flush with the back edges of the primary plates of said rear rigging structures, said back panel in abutting relation with the inward faces of the channel members of said rear rigging structures and thus inset from the rearward faces of the channel members of said rear rigging structures, said rigging structures, framing members and enclosure panels forming an enclosure for the loudspeaker, wherein said rigging structures are integrated into and flush with the external surface of the enclosure of the loudspeaker, and a plurality of links, each link extendable from one of the channel members of said rigging structures for linking said rigging structure with a corresponding rigging structure of the enclosure of an adjacent loudspeaker.

* * * * *